US005203793A

United States Patent [19]

Lyden

[11] Patent Number: 5,203,793

[45] Date of Patent: Apr. 20, 1993

[54] CONFORMABLE CUSHIONING AND STABILITY DEVICE FOR ARTICLES OF FOOTWEAR

[76] Inventor: Robert M. Lyden, 16384 SW. Estuary Dr., Apt #203, Beaverton, Oreg. 97006

[21] Appl. No.: 805,596

[22] Filed: Dec. 11, 1991

Related U.S. Application Data

[63] Continuation-in-part of Ser. No. 714,971, Jun. 13, 1991, Pat. No. 5,101,580, which is a continuation of Ser. No. 410,074, Sep. 20, 1989, abandoned.

[51] Int. Cl.[5] ..... A43B 13/18; A61F 5/14

[52] U.S. Cl. ..... 36/88; 36/93; 36/43; 36/44; 36/89; 36/71; 36/154; 36/180; 12/142 N; 12/146 M

[58] Field of Search ..... 36/88, 89, 28, 43, 69, 36/71, 44, 93, 91, 180, 145, 154; 12/142 N, 146 M

[56] References Cited

U.S. PATENT DOCUMENTS

| | | | |
|---|---|---|---|
| 2,092,910 | 9/1937 | Daniels | 36/71 |
| 3,237,318 | 3/1966 | Hanson | 36/2.5 |
| 4,272,898 | 6/1981 | Tansill | 36/44 |
| 4,385,024 | 5/1983 | Tansill | 264/223 |
| 4,520,581 | 6/1985 | Irwin et al. | 36/88 |
| 4,597,196 | 7/1986 | Brown | 36/44 |
| 4,628,621 | 12/1986 | Brown | 36/44 |
| 4,654,984 | 4/1987 | Brown | 36/44 |
| 4,674,206 | 6/1987 | Lyden | 36/88 |
| 4,688,338 | 8/1987 | Brown | 36/44 |
| 4,716,662 | 1/1988 | Bar | 36/44 |
| 4,718,179 | 1/1988 | Brown | 36/44 |
| 4,756,096 | 7/1988 | Meyer | 36/44 |
| 4,800,657 | 1/1989 | Brown | 36/44 |
| 4,813,090 | 3/1989 | Ibrahim | 12/142 N |
| 4,823,420 | 4/1989 | Bartneck | 12/142 N |
| 4,856,626 | 8/1989 | Nakanishi | 188/371 |
| 4,869,001 | 9/1989 | Brown | 36/115 |
| 4,901,390 | 2/1990 | Daley | 36/44 |
| 4,931,356 | 6/1990 | Misevich et al. | 428/283 |
| 4,946,435 | 9/1990 | Chu | 528/17 |
| 4,946,874 | 8/1990 | Lee | 522/14 |
| 4,957,963 | 9/1990 | Burns | 524/837 |
| 4,962,593 | 10/1990 | Brown | 36/44 |
| 4,983,450 | 1/1991 | Yanagihara et al. | 428/283 |
| 4,987,158 | 1/1991 | Eckberg | 522/31 |
| 5,010,115 | 4/1991 | Grisoni | 521/154 |
| 5,042,100 | 8/1991 | Bar | 12/142 N |
| 5,054,753 | 10/1991 | Polus | 267/153 |
| 5,067,257 | 11/1991 | Coomer | 36/93 |
| 5,095,570 | 3/1992 | Bar et al. | 12/146 M X |
| 5,101,580 | 4/1992 | Lyden | 36/93 |

*Primary Examiner*—Paul T. Sewell
*Assistant Examiner*—Ted Kavanaugh

[57] ABSTRACT

A conformable device (20) containing a conformable material (41) substantially comprising fluid matter which forms a resilient material substantially comprising solid matter after a working time is used in an article of footwear (44) in order to enhance conformance, comfort, fit, stability, cushioning and shock-absorption. The conformable material (41) is contained within a chamber (51) of suitable configurations. In addition, a foam material (66) of select shape generally conforming to a portion of the wearer's anatomy can be used in cooperation with the conformable material (41), as well as a void (40) containing a gas. The invention permits accommodation to a wide range of anatomical features and characteristics found amongst a large percentage of the general public and application within numerous types of footwear (44).

24 Claims, 12 Drawing Sheets

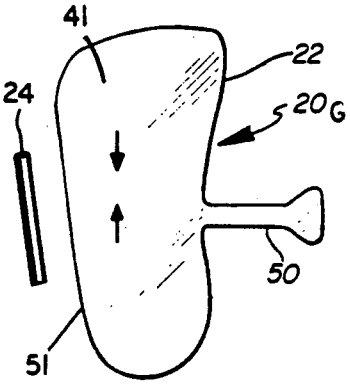
Fig. 11
Fig. 12a
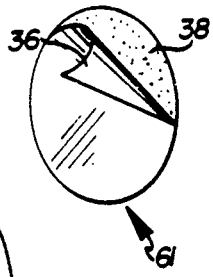
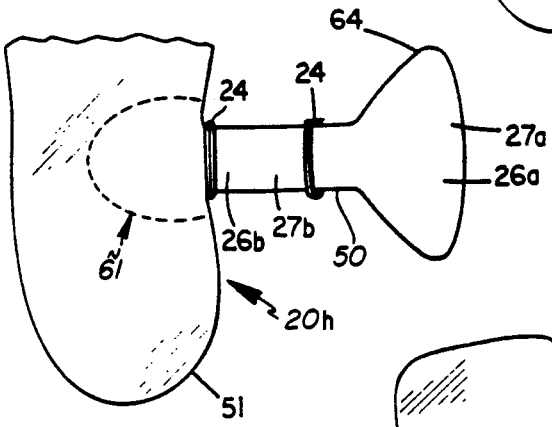
Fig. 12
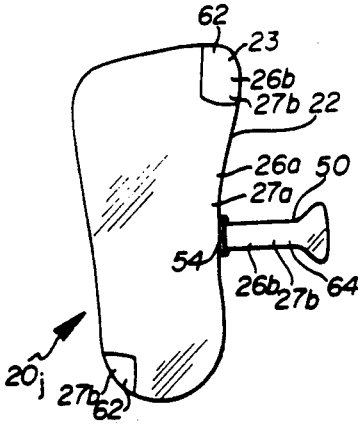
Fig. 14
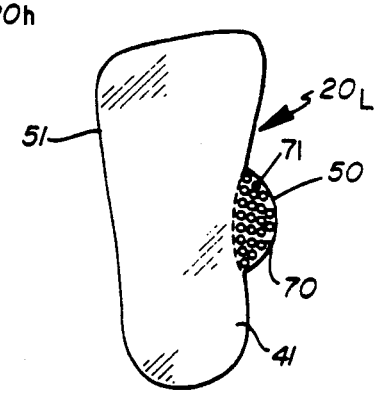
Fig. 16
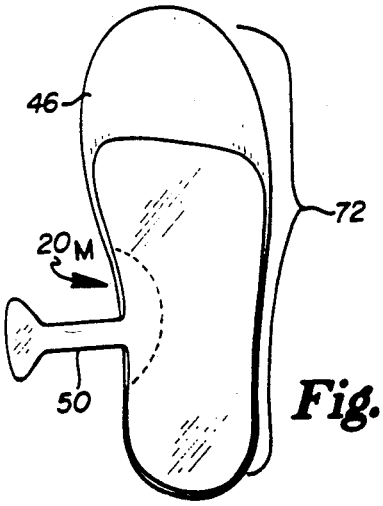
Fig. 17
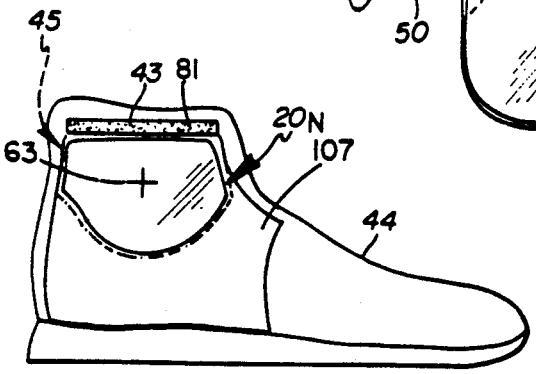
Fig. 18
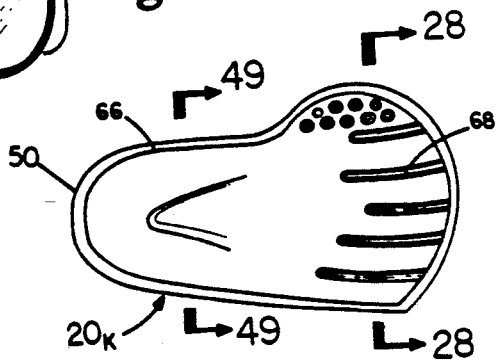
Fig. 15

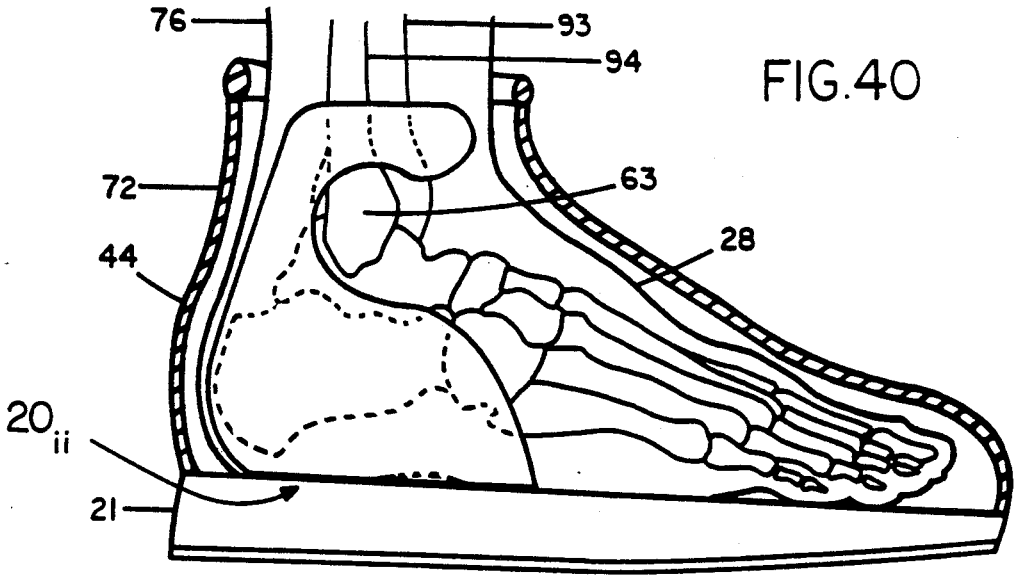
FIG.40
FIG. 41
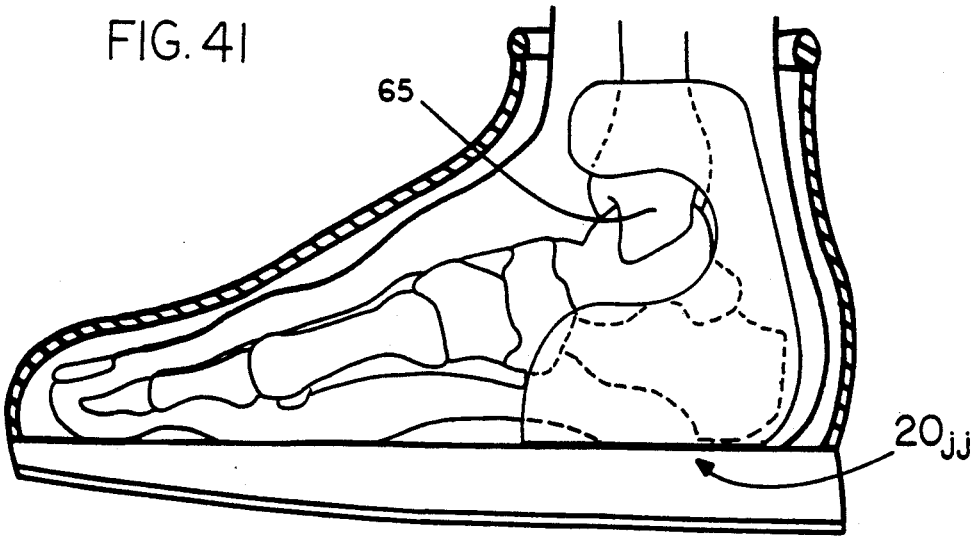
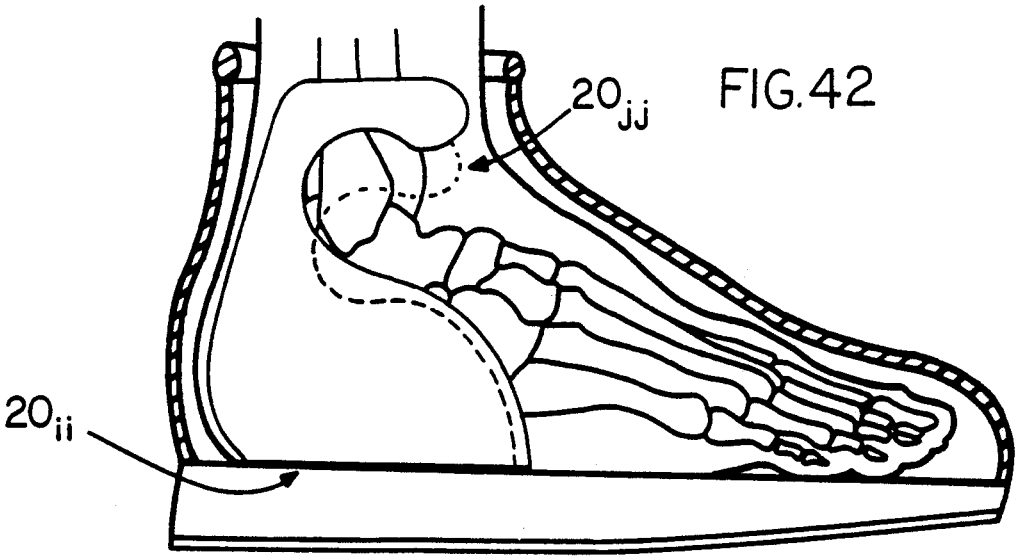
FIG.42

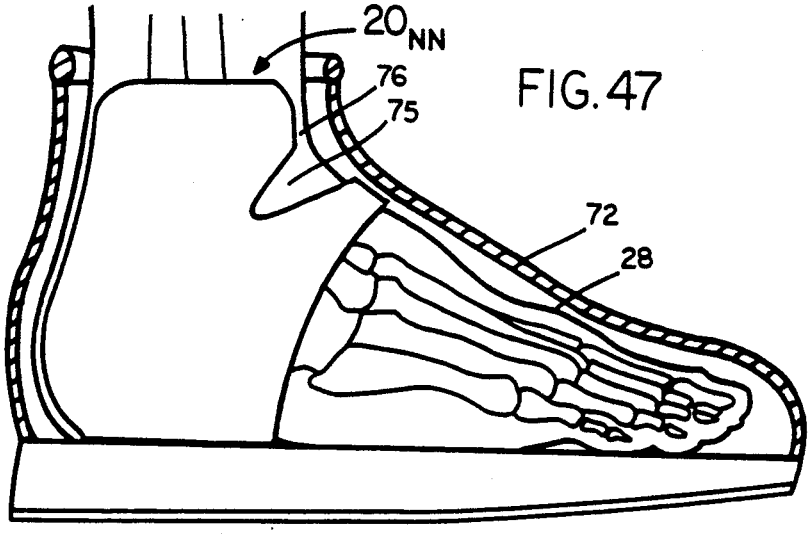
FIG. 47
FIG. 48
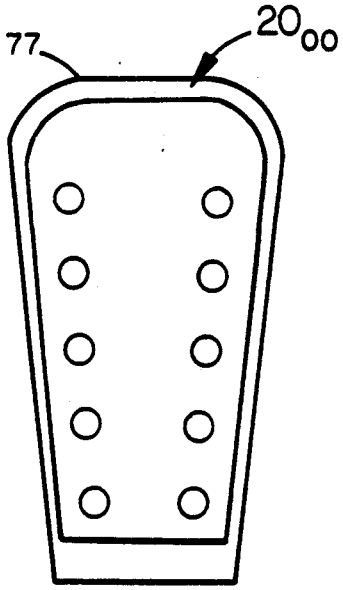
FIG. 46
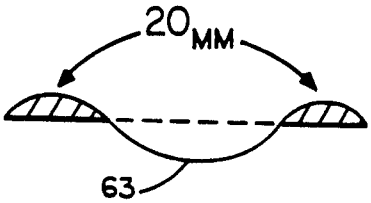
FIG. 49
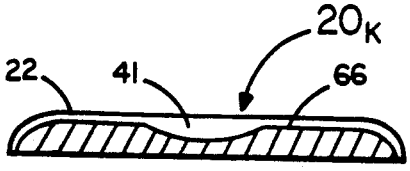
FIG. 50
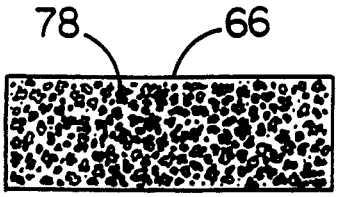
FIG. 51
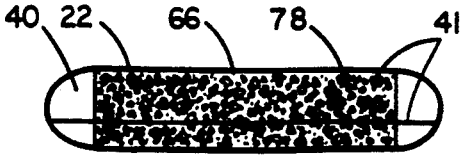

CONFORMABLE CUSHIONING AND STABILITY DEVICE FOR ARTICLES OF FOOTWEAR

CROSS REFERENCE TO RELATED APPLICATION

The present application is a continuation-in-part of co-pending application Ser. No. 07/714,971 filed Jun. 13, 1991 now U.S. Pat. No. 5,101,580 a file-wrapper-continuation of Ser. No. 07/410,074 now abandoned, filed Sep. 20, 1989, with cross-reference to U.S. Pat. No. 4,674,206, issued to the present inventor Robert M. Lyden, on Jun. 23, 1987.

DEFINITIONS

In this specification the term "rearfoot" is used to identify the area about the heal portion of the foot substantially containing the heel bones, i.e., the calcaneus and talus. The term "forefoot" is used to identify the foot portion about the ball and toes of the foot, i.e., the area substantially containing the phalanges, sesamoids, and the distal heads of the metatarsals. The term "midfoot" is used to identify the foot portion lying between the forefoot and rearfoot as defined above. The midfoot portion therefore lies rearwardly of the distal heads of the matatarsals and forwardly of the calcaneus and talus, and substantially contains the cuboid, navicular, cuneiforms, and includes the base and a substantial portion of the shaft of the metatarsals. The anterior-to-posterior axis is understood to extend in a horizontal orientation consistent with the sagittal plane with the toes being anterior and the heel being posterior. The medial-to-lateral or transverse axis is understood to extend in a horizontal orientation consistent with the frontal plane and perpendicular to and intersecting the anterior-to-posterior axis with medial being the side of the foot associated with the hallucus longus, i.e., the first toe, and lateral being the side of the foot associated with the fifth toe. The superior-to-inferior axis is understood to be perpendicular to both the medial-to-lateral axis and the anterior-to-posterior axis and intersects both at a single point and is substantially vertical in orientation consistent with a line formed by the intersection of the frontal and sagittal planes with the dorsal aspect of the foot being superior and the plantar aspect of the foot being inferior.

BACKGROUND OF THE INVENTION

Some individuals suffer debilitating podiatric conditions and require the fabrication of prescription orthotics by a medical doctor for remedial relief. However, many of the problems commonly experienced with articles of footwear by a large segment of the general public simply stem from inadequate conformance or fit, stability, support and comfort. Further, it can be readily understood that at least one of these problems can be related to the additional need or desire to attenuate force applications and resulting shock experienced by a wearer of footwear. Eversion of the foot is commonly referred to as pronation, whereas inversion of the foot is commonly referred to as supination. It is the aim of several preferred embodiments of the present invention to provide support and stability to the wearer's foot so that injurious conditions possibly arising from excessive pronation or supination can be mitigated, or avoided. Every individual has different anatomical features and characteristics. A practical problem to be solved: How to accommodate for individual differences and provide substantial conformance or fit, stability, support, comfort, and/or attenuate force applications and shock experienced by a user of articles of footwear?

Heretofore, there have been a number of attempted solutions to this problem which have enjoyed varied success. Obvious merits aside, some of the deficiencies of the prior art will be briefly addressed. For example, footwear orthotics prescribed by a medical doctor are sometimes required in select cases to remedy debilitating podiatric conditions. For some individuals, there is no other practical or prudent alternative which will provide remedial relief. However, footwear orthotics often take considerable time for a specialist to fabricate and can be relatively expensive. Prescription orthotics are not normally required for the general public to successfully enjoy the use of footwear.

Various thermally formable footwear devices have been introduced in the United States market and have enjoyed some commerical success. In particular, skate and ski boot manufacturers have made numerous attempts in this regard. However, the application of a thermally formable footwear device generally entails the use of a heating gun, or oven, or other heating and/or molding equipment and involves numerous procedures which must be administered by a retailer. While less expensive, such devices suffer many of the deficiencies of the prior art described herein.

Pre-formed "generic" products can accommodate a greater, or lesser number of individuals depending upon the degree to which characteristic norms corresponding to the user population have been incorporated in the design of such products. In particular, foam materials of select shape have been used to partially accomodate for anatomical differences and enhance the conforming properties of articles of footwear. However, as every individual possesses different anatomical features and characteristics, a pre-formed "generic" product will not accommodate every individual to the same degree.

Permanently inflated air bags, or "diffusion pumping devices" such as those taught by Marion F. Rudy, (e.g., U.S. Pat. Nos. 3,760,056, 4,183,156, and 4,340,626), and the like, have enjoyed considerable commerical success, and have enhanced the cushioning and shock-absorbing qualities of articles of footwear. However, the use of relatively high inflation pressures in permanently inflated air bags, and the like, generally achieves superior cushioning and shock-absorption at the expense of conformance, whereas relatively low inflation pressures achieve conformance at the expense of cushioning and shock-absorption.

Selectively inflatable air devices, e.g., those which can be manually actuated by a pumping mechanism, can attain substantial conformance with respect to a portion of a wearer's anatomy. However, the relatively low inflation pressures commonly associated with such devices do not provide for substantial cushioning, shock-absorption, or stability when such devices are subjected to the force applications commonly encountered by a wearer during the use of an article of footwear.

There have been a number of attempts to introduce conformable materials in a liquid or viscous state into articles of footwear in order to customize the article of footwear for an individual user. These materials remain in a liquid, or viscous state and when subjected to a force application and/or body heat become moldable in conformance with a portion of the wearer's anatomy. However, such materials and devices normally resume an unformed state upon removal of an article of footwear and are therefore without a "memory" capability. In addition, such materials can add undesirable weight to an article of footwear when used in substantial quantities.

In addition, there have been attempts to introduce conformable materials in a fluid state into an article of footwear which can be made to form a resilient material, e.g., substantially comprising an elastomeric resilient material consisting of solid matter, after a working time. Some of the prior art has proven deficient by virtue of inadequate design, or materials. Moreover, the procedures and methods associated with these attempts have for the most part been relatively complex, time consuming, expensive, or otherwise not amenable to mass production and use by the general public.

Lastly, a deficiency common to much of the prior art discussed above is the inability to exhibit select and varied mechanical or other physical properties as between select areas of a prior art footwear device. Most prior art devices are relatively homogenous with regards to their mechanical and other physical properties. Few prior art devices have the ability to be "tuned" to exhibit various desired mechanical or other physical properties in various select portions.

Accordingly, special attention is merited by a number of practical problems which are encountered when a preferred conformable material in a substantially fluid state, (e.g., a liquid, and/or viscous material which can be made to form an elastomeric resilient material substantially comprising solid matter after a working time), is used within a prior art reference, or a conformable cushioning and stability device of the present invention, hereafter simply referenced as a "conformable device." One problem arises out of the need or desire to limit the quantity and/or the weight by volume of the conformable material to be used within a conformable device. A second problem arises out of the need or desire to selectively vary the mechanical or other physical properties exhibited in select areas of a conformable device and thereby "tune" the mechanical or other physical properties exhibited in various portions of a conformable device. In any given application, a third problem arises out of the need or desire to accomodate the anatomical variation found in a large percentage of the user population with relatively few alternate embodiments of a conformable device. For example, different users will often displace different quantities of conformable material in attaining a desired condition when using the present invention. The present invention provides solutions to these and other problems.

SUMMARY OF THE INVENTION

The present invention relates to a conformable cushioning and stability device for use in articles of footwear which can enhance conformance, comfort, fit, stability, support, and attenuate force applications and shock experienced by users of articles of footwear. Accordingly, the present invention includes at least one device and method for accomplishing some or all of these desired tasks. Further, a conformable device used in the area of the footbed can increase the effective area of the midsole used to attenuate force applications by way of enhanced conformance. Therefore, it is possible for a user to enjoy superior cushioning with the use of a conformable device, or alternately, for footwear midsole elevations to be decreased in the production of articles of footwear, at least in part, without compromising a given level of cushioning quality. Decreased heel elevations can be associated with improved footwear stability. The ability to provide mess produced articles of footwear makes the invention available for use by the general public.

A preferred embodiment of the present invention includes, but is not limited to, a conformable device which can be used to form a customized sockliner for use in an article of footwear. The sockliner is so designed and configured that the plantar aspect of the ball and heel of a wearer's foot preferably rest in proximate communication upon a supporting surface of the footbed of an article of footwear. The conformable material contained within a preferred sockliner embodiment of the present invention is substantially displaced between the footbed and the wearer's foot such that the fit imparted by the corresponding footwear last is substantially uncompromised. Nevertheless, an area about the rearfoot and midfoot including one or more arches of a wearer's foot, and if desired other foot portions, can enjoy enhanced conformance, comfort, fit, support, stability, and attenuation of force applications and shock through the use of a conformable device of the present invention. In addition, a preferred sockliner embodiment of a conformable device can utilize conventional means for removable attachment within an article of footwear to prevent dislocation during use, but permit easy removal and replacement.

In addition, it can be readily understood that a conformable device of suitable configurations can also be employed within an article of footwear in the area about the malleolli, or ankle joint in order to enhance stability, support and comfort. Moreover, suitable alternate embodiments of the present invention permit the introduction of custom sockliners, footbeds, midsoles, outsoles, soles, heel counters, straps, closure means, air bags, (and other cushioning or shock absorbing devices), stability devices, and shoe uppers, including, but not limited to the collar and tongue portions of an article of an footwear. It can be readily understood that the use of a custom conformable device with an article of footwear can at least partially accommodate the unique anatomical features and characteristics of a portion of a wearer's anatomy.

A preferred embodiment of the present invention comprises a conformable device for use in an article of footwear and conforming to and supporting a portion of a wearer's anatomy comprising a chamber having inner volume, said chamber comprising at least in part a pliable casing, said pliable casing at least partially comprising a selectively permeable material to gases including water vapor, a conformable material substantially comprising liquid matter substantially comprising an aqueous emulsion which can comprise a resilient material substantially comprising solid matter after a woriing time when water in the form of gaseous water vapor evaporates from said conformable material into the atmosphere, said conformable material contained within said chamber and displacing at least a portion of said inner volume, a physical barrier substantially isolating said chamber from said atmosphere, whereby when said physical barrier is removed and a portion of said wearer's anatomy is positioned in functional relation to said conformable device causing a force application to be made thereupon and causing at least a portion of said conformable device to be formed in substantial conformance with said portion of said wearer's anatomy, said conformable device substantially retains the shape imparted by said portion of said wearer's anatomy when said conformable material substantially comprises said resilient material after a working time.

Further, in accordance with a preferred embodiment of the present invention, the portion of the wearer's anatomy comprises the wearer's foot and said foot has a heel, arches, and metatarsal heads, and the conformable device at least partially underlies the arches and extends from an area about the heel to an area rearward of said metatarsal heads.

Further, in accordance with a preferred embodiment of the present invention, the aqueous emulsion comprises an aqueous silicone emulsion.

Further, in accordance with a preferred embodiment of the present invention, the evaporation of water in the form of water vapor initiates a cross-linking chemical reaction causing the conformable material to substantially comprise a resilient material after a working time.

Further, in accordance with a preferred embodiment of the present invention, including a foam material substantially comprising solid matter having select form generally conforming to a portion of said wearer's anatomy placed in communication with the inner volume of the conformable device, whereby the conformable material can be placed in communication with said foam material and the select and coordinated use of said foam material with said conformable material provides select mechanical properties as between at least two portions of said conformable device when said conformable material forms said resilient material after a working time.

Further, in accordance with a preferred embodiment of the present invention, the conformable device at least partially attenuates force applications and dampens shock.

Further, in accordance with a preferred embodiment of the present invention, the change in the phase state of said conformable material is reversable and the resilient material substantially comprising solid matter can be caused to comprise the conformable material substantially comprising liquid matter.

A preferred method for making a conformable device of the present invention for use in an article of footwear and conforming to and supporting a portion of a wearer's anatomy comprises the following steps:

a) selecting an article of footwear;

b) selecting a conformable material substantially comprising liquid matter substantially comprising an aqueous emulsion which can comprise a resilient material substantially comprising solid matter after a working time when placed in fluid communication with the atmosphere to cause the evaporation of water in the form of water vapor from said aqueous emulsion;

c) selecting a chamber having inner volume at least partially comprising a pliable casing, said pliable casing at least in part selectively permeable to gases including water vapor;

f) placing said conformable material within the inner volume of said chamber;

g) providing a physical barrier to substantially isolate said conformable material contained within the inner volume of said chamber from fluid communication with said atmosphere;

i) removing said physical barrier;

j) placing said conformable material in fluid communication with said atmosphere to initiate said conformable material to comprise said resilient material;

k) positioning said conformable device within said article of footwear; and l) positioning a portion of said wearer's anatomy in functional relation with said article of footwear causing a force application to be made upon said conformable device and causing at least a portion of said conformable device to be formed in substantial conformance with said portion of said wearer's anatomy, said conformable device at least partially retaining the shape imparted by said portion of said wearer's anatomy when said conformable material substantially comprises said resilient material after a working time.

Further, in accordance with a preferred method of the present invention, the portion of said wearer's anatomy comprises the wearer's foot and said foot has a heel, arches, and metatarsal heads, and the conformable device at least partially underlies the arches and extends from an area about the heel to an area rearward of said metatarsal heads.

Further, in accordance with a preferred method of the present invention, the aqueous emulsion comprises an aqueous silicone emulsion.

Further, in accordance with a preferred method of the present invention, the evaporation of water in the form of water vapor initiates a cross-linking chemical reaction causing the conformable material to substantially comprise a resilient material after a working time.

Further, in accordance with a preferred method of the present invention, including a foam material substantially comprising solid matter having select form generally conforming to a portion of the wearer's anatomy placed in communication with the inner volume of the conformable device, whereby said conformable material can be placed in communication with said foam material and the select and coordinated use of said foam material with said conformable material provides select mechanical properties as between at least two portions of said conformable device when said conformable material forms said resilient material after a working time.

Further, in accordance with a preferred method of the present invention, the conformable device can be removably positioned in an article of footwear.

In accordance with an alternate preferred embodiment of the present invention, a conformable device for use in an article of footwear and conforming to and supporting a portion of a wearer's anatomy comprising a chamber having inner volume, said chamber comprising at least in part a pliable casing, said pliable casing at least partially comprising a selectively permeable material to gases including water vapor capable of causing a change in the phase state of a conformable material substantially comprising liquid matter which can comprise a resilient material substantially comprising solid matter after a working time when placed in fluid communication with said gases including water vapor, said conformable material contained within said chamber and displacing at least a portion of said inner volume, a physical barrier substantially isolating said chamber from said gases including water vapor, whereby when said physical barrier is removed and a portion of said wearer's anatomy is positioned in functional relation to said conformable device causing a force application to be made thereupon and causing at least a portion of said conformable device to be formed in substantial conformance with said portion of said wearer's anatomy, said conformable device substantially retains the shape imparted by said portion of said wearer's anatomy when said conformable material substantially comprises said resilient material after a working time.

In accordance with an alternate preferred embodiment of the present invention, an alternate method for making a conformable device for use in an article of footwear and conforming to and supporting a portion of a wearer's anatomy comprises the following steps:

a) selecting an article of footwear;

b) selecting a conformable material substantially comprising liquid matter which can comprise a resilient material substantially comprising solid matter after a working time when placed in fluid communication with gases including water vapor;

c) selecting a chamber having inner volume at least partially comprising a pliable casing, said pliable casing at least in part selectively permeable to said gases including water vapor;

f) placing said conformable material within the inner volume of said chamber;

g) providing a physical barrier so as to substantially isolate said conformable material contained within the inner volume of said chamber from said gases including water vapor;

i) removing said physical barrier;

j) placing said conformable material in fluid communication with said gases including water vapor to initiate said conformable material to comprise said resilient material;

k) positioning said conformable device within said article of footwear; and l) positioning a portion of said wearer's anatomy in functional relation with said article of footwear causing a force application to be made upon said conformable device and causing at least a portion of said conformable device to be formed in substantial conformance with said portion of said wearer's anatomy, whereby said conformable device at least partially retains the shape imparted by said portion of said wearer's anatomy when said conformable material substantially comprises said resilient material after a working time.

In accordance with an additional alternate preferred embodiment of the present invention, a conformable device for use in an article of footwear and conforming to and supporting a portion of a wearer's anatomy comprising a chamber having inner volume, said chamber comprising at least in part a pliable casing, said chamber comprising at least in part a pliable casing, said pliable casing at least partially comprising a selectively permeable material to select frequencies and wavelengths of electromagnetic radiation capable of causing a change in the phase state of a conformable material substantially comprising liquid matter which can comprise a resilient material substantially comprising solid matter after a working time when placed in communication with said select frequencies and wavelengths of electromagnetic radiation, said conformable material contained within said chamber and displacing at least a portion of said inner volume, a physical barrier substantially isolating said chamber from said select frequencies and wavelengths of electromagnetic radiation, whereby when said physical barrier is removed and said conformable material is placed in communication with said select frequencies and wavelengths of electromagnetic radiation to initiate said conformable material to comprise said resilient material and a portion of said wearer's anatomy is positioned in functional relation to said conformable device causing a force application to be made thereupon and causing at least a portion of said conformable device to be formed in substantial conformance with said portion of said wearer's anatomy, said conformable device substantially retains the shape imparted by said portion of said wearer's anatomy when said conformable material substantially comprises said resilient material after a working time.

Further, in accordance with the additional alternate preferred embodiment, the select frequencies and wavelengths of electromagnetic radiation comprise ultraviolet light.

In accordance with an additional alternate preferred embodiment of a conformable device, an additional alternate method for making a conformable device for use in an article of footwear and conforming to and supporting a portion of a wearer's anatomy comprising the following steps:

a) selecting an article of footwear;

b) selecting a conformable material substantially comprising liquid matter which can comprise a resilient material substantially comprising solid matter after a working time when placed in communication with select wavelengths and frequencies of electromagnetic radiation;

c) selecting a chamber having inner volume at least partially comprising a pliable casing, said pliable casing at least in part selectively permeable to said select wavelengths and frequencies of electromagnetic radiation;

f) placing said conformable material within the inner volume of said chamber;

g) providing a physical barrier so as to substantially isolate said conformable material contained within the inner volume of said chamber from said select frequencies and wavelengths of electromagnetic radiation;

i) removing said physical barrier;

j) placing said conformable material in communication with said select frequencies and wavelengths of electromagnetic radiation to initiate said conformable material to comprise said resilient material;

k) positioning said conformable device within said article of footwear; and l) positioning a portion of said wearer's anatomy in functional relation with said article of footwear causing a force application to be made upon said conformable device and causing at least a portion of said conformable device to be formed in substantial conformance with said portion of said wearer's anatomy, whereby said conformable device at least partially retains the shape imparted by said portion of said wearer's anatomy when said conformable material substantially comprises said resilient material after a working time.

In accordance with the additional alternate preferred method, the select frequencies and wavelength of electromagnetic radiation comprise ultraviolet light.

The present invention also includes still another additional preferred method for conforming to and supporting a portion of a wearer's anatomy in relation to an article of footwear comprising the following steps;

a) selecting an article of footwear substantially containing and underlying a wearer's foot;

b) selecting a pliable casing forming a chamber having inner volume;

c) selecting a first reagent and a second reagent which can be made to mix to yield a conformable material which comprises an elastomeric resilient material substantially comprising solid matter after a working time;

d) selecting a foam material comprising solid matter having select form generally conforming to a selected portion of said wearer's anatomy;

e) placing said foam material within said chamber;

f) providing a restraint to selectively separate the inner volume of said chamber into first and second enclosures so that said first and second enclosures are not in fluid communication with each other;

g) placing said first reagent into said first enclosure;

h) placing said second reagent into said second enclosure;

i) removing said restraint thereby placing said first reagent and said second reagent in fluid communication whereby said first and second reagent can be mixed to form said conformable material and at least partially encapsulate said foam material;

j) positioning said chamber within an article of footwear; and k) positioning a portion of the wearer's anatomy in functional relation with said article of footwear thereby causing a force application to be made upon said chamber and causing at least a portion of said chamber to be formed in substantial conformance with said portion of said wearer's anatomy, said chamber at least partially retaining the shape imparted by said portion of said wearer's anatomy when said conformable material substantially comprises said resilient material after a working time.

Further, in accordance with the still further alternate method, the conformable material includes a blowing agent and comprises a resilient material after a working time.

Further, in accordance with a still further alternate method, including a void substantially filled with a gas displacing at least a portion of the inner volume of the conformable device.

The procedures and methods associated with the use of various preferred embodiments of the present invention are few and simple to perform, thus render use by the general public both possible and practical. Further objects and advantages of the invention will become apparent from a consideration of the drawings and ensuing description of it.

The above described features and advantages, along with various other advantages and features of novelty are pointed out with particularity in the claims of the present application which are attached hereto. However, for a better understanding of the invention, its advantages, and objects obtained by its use, reference should be made to the drawings which form a further part of the present application and to the accompanying descriptive material in which there is illustrated and described preferred embodiments of the present invention.

BRIEF DESCRIPTION OF THE DRAWINGS

FIG. 11 is a top plan view of an alternate conformable device of the present invention after removal of a restraint separating two reagents which form a resilient material showing an appendage to permit displacement of resilient material between the chamber and appendage of the conformable device;

FIG. 12 is a top plan view of a portion of an alternate conformable device similar to that shown in FIG. 11 showing the appendage used as a reservoir for two reagents, a first restraint selectively separating the appendage into two portions and thereby separating two reagents, and a second restraint selectively separating the appendage from the chamber of the conformable device;

FIG. 12*a* is a top plan view of a patch showing a protective release material being removed to expose a self-adhesive surface on the patch for attachment to a conformable device after the removal of an appendage;

FIG. 14 is a top plan view of an alternate embodiment of a conformable device showing an internal breakable enclosure selectively separating a first reagent within the enclosure from a second reagent contained within the inner volume of the chamber of the conformable device, also shown is the alternate use of an appendage containing a first reagent selectively separated by a restraint from a second reagent contained within the inner volume of the chamber of the conformable device;

FIG. 15 is a top plan view of an alternate embodiment of a conformable device underlying and supporting a portion of a wearer's foot showing the use of a foam material of desired shape within the conformable device configured so as to enable selective encapsulation of the foam material by a conformable material forming a resilient material after a working time;

FIG. 16 is a top plan view of an alternate embodiment of a conformable device showing the use of a structural pattern to selectively position resilient material within the conformable device, also the use of openings for the ventilation of matter;

FIG. 17 is a bottom plan view of an alternate embodiment of a conformable device showing an overlying insole liner affixed to the conformable device, thus forming a one-piece unit for positioning in an article of footwear, also shown in phantom is a similar alternate conformable device limited to the area about the medial arch(es);

FIG. 18 is a side view of a high-top article of footwear showing an alternate conformable device positioned in the area about the malleolus;

FIG. 40 is a lateral view of a conformable device for use in an article of footwear in the area about the lateral malleolus showing the relation of the conformable device to various bones of a wearer's foot;

FIG. 41 is a medial view of a conformable device for use in an article of footwear in the area about the medial malleolus showing the relation of the conformable device to various bones of a wearer's foot;

FIG. 42 is a superimposed view of the conformable devices of FIGS. 40 and 41 showing the presence of asymmetry between the lateral and medial embodiments;

FIG. 46 is a cross-sectional view along the transverse plane of the conformable device of FIG. 45, along line D—D;

FIG. 47 is a lateral view of an alternate conformable device which is in communication with the lateral, superior or dorsal, and medial aspects of a wearer's foot showing a notched area about the distal aspect of the wearer's leg and superior aspect of the foot anterior to the lateral and medial malleolii;

FIG. 48 is a superior plan view of a conventional footwear tongue showing the use of a conformable device;

FIG. 49 is a cross-sectional view of the conformable device of FIG. 15, along line B—B;

FIG. 50 is a cross-sectional view showing a representation of the structure of an open celled foam;

FIG. 51 is a cross-sectional perspective view showing the partial penetration of a resilient material into the cellular spaces of an open celled foam;

DETAILED DESCRIPTION OF THE PREFERRED EMBODIMENTS

Figure 1:
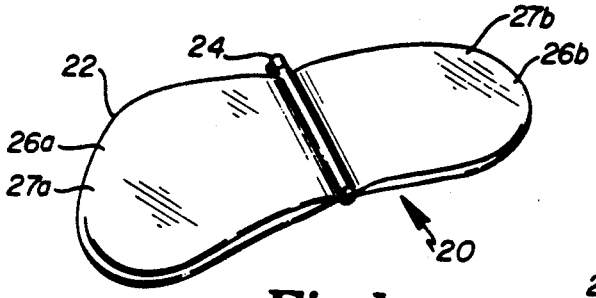
FIG. 1 is a perspective view of a conformable device of the present invention having separated compartments separated by a restraint and separates two reagents that form a resilient material.

Referring to the figures, wherein like reference numerals represent like parts throughout the several views, a conformable device 20 for use as a sockliner is shown in its original state in FIG. 1. The conformable device 20 is formed at least in part by a substantially pliable casing 22, approximately 0.0508–1.21 mm (0.002–0.050 inches) in thickness. Other thicknesses can be suitable depending upon the material(s) being used, and the method and process of manufacture. The pliable casing 22 can be made from a material related to the group of plastics, thermoplastics, polymers, copolymers, natural and synthetic rubbers, consisting of silicone, urethane, polyurethane, polyester, polyethylene, polycarbonate, polyvinyl chloride, propylene, polypropylene, polyamide, neoprene, styrene, nylon, vinyl, nitrile, TYVEC®, TEFLON®, TEDLAR®, MYLAR®, melamine, melinex, HYPALON®, LEXANE®, butadiene acrylonitrile and styrene rubber, latex, other natural and synthetic rubbers, and the like. In addition, a pliable casing 22 can also be formed at least in part by a leather material, a foam material, a fabric, textile, or composite material, whether these various materials be used singly, or in partial or complete combination.

The pliable casing 22 forms at least one chamber 51 having inner volume and consists of a durable material, thus enabling a conformable device 20 to widthstand force applications which are anticipated during normal use. The pliable casing 22 is heat/pressure sealed, welded by radio frequency induction, vacuum formed, blow-molded, or otherwise formed, bonded or affixed along any mating edges using conventional techniques so as to render a conformable device 20 a substantially self-enclosed unit. In addition, the preferred pliable casing 22 can be subjected to plasma or corona etching, or can otherwise be treated by conventional means to improve the bonding capability of the pliable casing 22 to various materials.

It can be readily understood that an alternate embodiment of conformable device 20, and the like, can have a plurality of chambers 51 which are in continuous fluid communication. Further, alternate embodiments of conformable device 20 can have a plurality of individual chambers 51. In addition, different individual chambers 51 within a conformable device 20 can contain different material components and can thereby exhibit different mechanical properties. Moreover, different chambers 51 having different form and/or inner volume containing like material components can also exhibit different mechanical properties. Obviously, an article of footwear can employ a plurality of conformable device(s).

Figure 6:
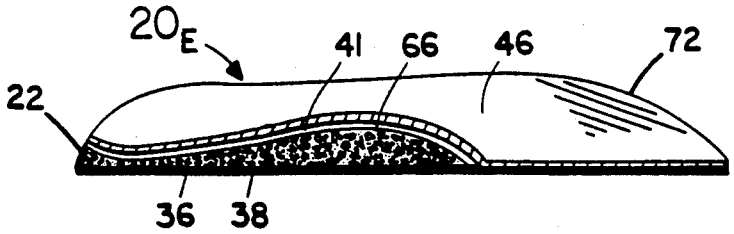
FIG. 6 is a cross-sectional perspective view along the anterior-to-posterior axis of a conformable device similar to FIG. 3, but with the addition of an overlying sockliner material which serves as a structural element of the conformable device, and an underlying protective release material which can be removed to expose a self-adhesive surface.
Figure 65:
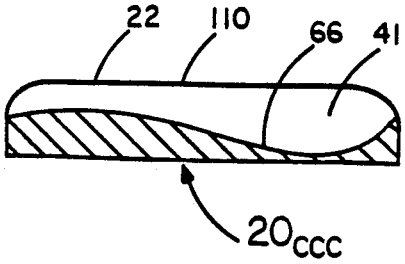
FIG. 65 is a cross-sectional view of a conformable device having at least a portion of the pliable casing formed by a foam material which is shaped to generally conform to a portion of a wearer's anatomy.

It can be readily understood that members of pliable casing 22 can be affixed to a different overlying material to form a chamber 51 of a conformable device. For example, as shown in FIG. 6, a conformable device 20*e* can be formed in association with an overlying sockliner and use a portion of the sockliner for structural integrity and enclosure. In addition, the overlying sockliner can consist at least in part of a foam material and the inferior portion thereof substantially contained within the inner volume of a conformable device can be formed to a select shape to generally conform to a portion of a wearer's anatomy so as to simultaneously serve the function of a pliable casing, and a foam material of select shape (not shown). Alternatively, as shown in FIG. 65, a different portion of pliable casing 22 can consist of a foam material which can be formed to a select shape such that the portion of the foam material 66 in communication with the inner volume of a conformable device 20*ccc* is generally shaped to substantially conform to a portion of a wearer's anatomy. Further, it can be readily understood that at least one chamber 51 suitable for use in the present invention can be formed by at least one material which serves to substantially enclose and thereby define the inner volume of a conformable device without the necessary presence of a pliable casing 22. In addition, in some embodiments of the present invention the material contained within the inner volume of a conformable device can be removed from within the pliable casing after the conformable device has been formed in at least partial conformance to a wearer and be used as a custom footwear insert.

Ideally, a conformable device should be specifically designed for the article of footwear in which the application is to be made. A conformable device would then vary in design, configuration and dimensions depending upon the particular application.

Figure 29:
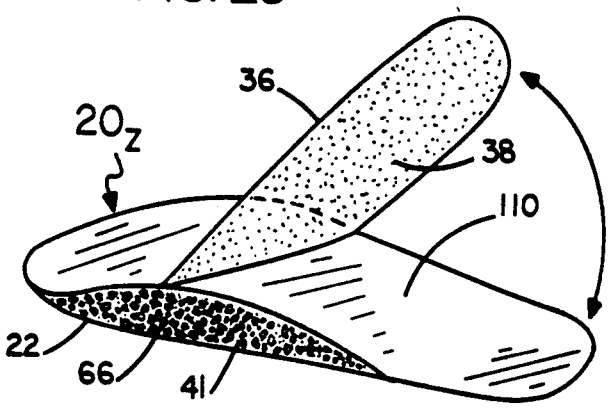
FIG. 29 is a perspective view of a conformable device having a portion of pliable casing consisting of a selectively permeable barrier material substantially permeable to gases and water vapor, but substantially resistant to the passage of the conformable material.

The possible use of a selectively permeable material in at least a portion of pliable casing 22 is anticipated in various embodiments of the present invention, e.g., select permeability to select gases including water vapor, water in liquid form, or preferred frequencies and wavelengths of electromagnetic radiation, or light. LITE-TAK ® products, made by Loctite Corporation of Newington, Conn., and the like, which set and/or cure when exposed to ultra-violet light provide one such example, although other conformable materials are contemplated, e.g., ultra-violet light can be similarly used with select silicone elastomers. Alternatively, a conformable material, e.g., a silicone elastomer which can be made to set and/or cure when placed in communication with water vapor, or water in liquid form can be used. Usable water vapor cure silicone materials include, but are not is limited to silicone sealants produced by Dow Corning Corporation of Midland, Mich., e.g., Dow Corning Sealants 732, 734, 736, and 737. Dow Corning product information and technical data sheets are attached to the present application and incorporated by reference herein. As shown in FIG. 29, a conformable device 20z, and the like, can utilize a fabric, textile, or other selectively permeable material 110 which is substantially impermeable to liquid matter, but substantially permeable to gases including water vapor. Alternatively, the pliable casing 22 can be selectively permeable to gases and at least one select liquid reagent, e.g., water in liquid form, in at least a portion of the pliable casing 22, but nevertheless be substantially impermeable to the reagent(s) contained within the inner volume of a conformable device. Embodiments of the present invention which utilize a selectively permeable pliable casing 22 with respect to gases including water vapor, merit special attention regarding their various principles of operation, composition and structure.

A recent review of substantially waterproof, but nevertheless substantially breathable fabrics with respect to gases including water vapor was published in the September, 1991 issue of *Ski Tech*, incorporated herein by reference. The materials which can be used to form a selectively permeable pliable casing 22 are varied and many, but these materials can be generally grouped into monolithic or non-porometric, and porometric categories. The former generally consist of relatively homogenous materials, whereas the latter commonly utilize laminate treatments which can exhibit millions of tiny pores.

The best known water vapor breathable treatments are of the porometric variety and commonly include coatings, or membranes which are laminated to a fabric or textile substate. GORETEX ®, manufactured by W. L. Gore and Associates, of Newark, Del. is an example of one such selectively permeable material. The principles of operation and composition of GORETEX ® is disclosed in detail within U.S. Pat. Nos. 4,344,999, 4,443,511, 4,599,810, 4,809,447, 4,868,928, 4,899,465, 4,961,985, 5,014,363, incorporated herein by reference. THINTEC ®, manufactured by 3M Company, of St. Paul, Minn. constitutes a microporometric material. Technical data sheets provided by 3M company, incorporated herein by reference, disclose the composition of THINTEC ® laminate as consisting of 75% polyurethane and 25% polyolefin which is then applied to a customer's specified fabric substrate. Detailed technical information concerning ASTM test methods for waterproofness and breathability are included in the above references, and are incorporated herein by reference.

Other microporous treatments include, but are not limited to BIOOHIN ® of Asahi Chemicals, CELTECH ® and EXCELTEC ® of Unitika, CERAX ® of Sominex Prints, DERMOFLEX ® of Consoltex Fabrics, EINTECS ® of Tomen-Ein, ENTRANT ® of Toray Industries, HELLY-TECH ® of Helly Hansen, PERMIA ® of Somitex Prints of California, UCECOAT ® 2000 ® of UCB Chemicals, and ULTREX ® of Burlington Industries. In brief, the pores in water vapor permeable porometric materials are small enough to substantially resist the passage of water molecules in liquid form. This is due in part to surface tension caused by imbalanced molecular forces. Nevertheless, water vapor in a gaseous state can pass by diffusion or convection through what may be millions of tiny pores in the fabric, or textile.

Monolithic, or non-porometric materials form a substantial barrier against the passage of water in liquid form. In brief, when in a liquid state water molecules are strongly attracted to one another and cannot substantially interact with molecules of the monolithic membrane, thus water is repelled. However, water vapor molecules in a gaseous state can readily interact with molecules within the monolithic membrane with which they have an affinity and can use the membrane's molecular chains for transmission through the fabric or textile. Examples of monolithic, or non-porometric materials include, but are not limited to AQUAGUARD/CLIMALINER ® of Rotofil, BION II ® of Boldschmidt Chemical Co., DARLEXX ® of Darlington Fabrics Corp., DRYPEL ® of Du Pont, MICROTECH ® of Travis Textiles, SYMPATEX ® of Akzo, and TRIAD ® of Harrison Technologies.

Microfibers merit special attention because they can be readily used for porometric or monolithic applications. The textils industry defines microfiber or microdenier yarns as those which exhibit less than a 1 denier per filament (dpf) count. The denier per filament count of silk is approximately 1 denier, thus even the least fine microfibers are still finer than silk. Microfiber fabric include, but are not limited to CHAMISTE ® of Toray, CLIMAGUARD ® of Schoeller/Rotofil, C.D.Y. "MICRO" ® and GYMSTAR PLUS ® of Unitika America, FORTREL MICROSPUN ® of Fiber Industries, LEOFINO ® of Asashi, MICROSOFT ® of Tejin, MICROSUPPLEX ® of Du Pont, TACTEL MICRO ® of ICI Fibers, TREVIRA FINESSE ® of Hoechst A.G., ULTREX ® and VERSATECH ® of Burlington Industries, and ZEPHYR 200 ® of Kanebo Ltd.

Most of the selectively permeable textiles, fabrics, and treatments discussed hitherto have focused on the ability to keep water molecules in liquid from substantially penetrating a textile or fabric "barrier" while permitting water vapor molecules in gaseous form to pass through the same textile or fabric. The present invention can utilize these same principles and materials, but in this case the desire is to substantially contain a conformable material 41, e.g., a silicone material substantially consisting of fluid matter. At the same time, when a water vapor cure conformable material 41 is being used, it is desirable for water vapor in a gaseous form to pass through the pliable casing 22 at a relatively high rate in order to initiate the chemical reaction(s) which will cause the conformable material 41, e.g., a silicone material, to set and/or cure. Fortunately, the size of the molecules corresponding to silicone materials which are suitable for use in the present invention are relatively large as compared with water molecules. The chemical formula for a water molecule is H—O—H, whereas the relatively complex chemical formulas for several silicone elastomers are disclosed, e.g., in the following patents assigned to the Dow Corning Corporation, incorporated by reference herein: U.S. Pat. Nos. 4,923,754, 4,946,874, 4,956,435, 4,957,963, and 5,010,115. This means that it is possible to utilize materials in the construction of a pliable casing 22 for the present invention which have relatively large pores, i.e., but not so large as to permit the conformable material 41, e.g., a silicone material, to pass through the pliable casing 22, or other barrier. Generally speaking, when a water vapor cure conformable material 41 is being used, it is desirable to utilize a material in a pliable casing 22 for the present invention having as many pores, and as large a pore diameter as possible keeping in mind the above restriction. This will help to accelerate the setting and/or cure of the conformable material 41, e.g., silicone elastomer, which is being used. The cure time for water vapor cure silicones can be approximately 6–7 hours at room temperature (77 degrees Fahrenheit), and 50% humidity. However, the temperature within an article of footwear can range well above 100 degrees fahranheit and the humidity present within an article of footwear is commonly in excess of 90%, as evinced by the presence of moisture within many wearers' shoes. These conditions of relatively high temperature and humidity serve to accelerate the rate of reaction of water vapor cure silicone elastomers.

When using a water vapor cure conformable material 41, it can be desireable to utilize a hydrophilic, i.e., a "water-loving" material, in communication with pliable casing 22, e.g., as part of an overlying sockliner, so as to direct moisture towards the selectively permeable pliable casing 22. Further, at least a portion of a pliable casing 22 can utilize a hydrophilic or water transporting material. Some of the waterproof-breathable products and treatments disclosed above utilize these principles and manner of construction, e.g., THINTEC® manufactured by 3M company. In addition, both natural and synthetic leathers can exibit a number of the properties desired for use in a pliable casing 22, as described herein.

As shown in FIG. 29, the pliable casing 22 can utilize a removable protective release material 36 which when removed can expose the fabric, textile, or other selectively permeable material 110 to water vapor present in the atmosphere, and in particular, to water vapor introduced within an article of footwear by the perspiration of a wearer. Further, the conformable device can be sealed in an envelope, or otherwise be selectively isolated by conventional means from exposure to water in vapor or liquid form. Conventional means known to those in the packaging industry include the use of MYLAR®, SARAN®, metallic foils, and the like. These barrier materials can be used singly, or in partial or complete combination, and are frequently used with other plastic materials in a laminate construction. In addition, a desiccant material can be included within the package to provide additional protection and indicate whether the contents of the package have been "contaminated." In any case, once the barrier material to the external environment is removed or compromised water vapor can then penetrate at least a portion of the pliable casing 22 of conformable device **20*z*, and the like, and induce the setting and/or curing of the conformable material 41** contained therein.

Figure 26:
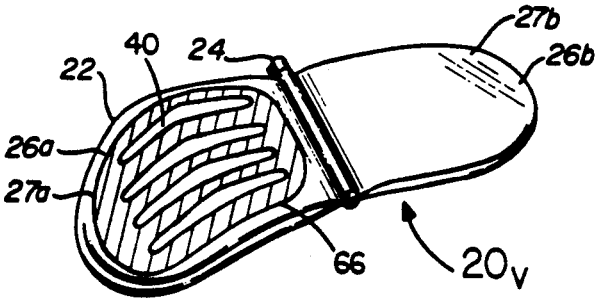
FIG. 26 is a perspective view of an alternate conformable device showing the use of one or more voids containing a gas within the conformable device.

In those embodiments in which the selectively permeable characteristic of the pliable casing is limited to select permeability to select gases, or alternatively, the pliable casing is actually impermeable to gases, at least one gas can be used within a conformable device **20*v*, as shown in FIG. 26, and the like. It can be readily understood that at least one gas substantially located in at least one void within the inner volume of a conformable device can be present in several embodiments of the present invention. In some embodiments, the quantity of the reagents and a substantially entrapped gas initially introduced within a conformable device can be regulated during production. Any entrapped gas(es) will form at least one void 40 within the inner volume of a conformable device 20*v***. When left unrestrained by an internal structure entrapped gas(es) will naturally tend to rise to the highest point(s) within the inner volume of a conformable device. It can then be desired to introduce at least one internal structure (not shown) within some embodiments of the present invention to ensure select containment of entrapped gas(es). The inclusion of entrapped gas(es) can serve to reduce the weight by volume of a conformable device, aid in cushioning, aid in heat dissipation, or otherwise positively affect the mechanical properties of a conformable device.

As shown in FIG. 16, a pliable casing 22 can be selectively affixed or otherwise formed by conventional means to comprise at least one structural pattern 70. A structural pattern 70 can selectively contain and direct the movement of conformable material 41 within a conformable device. In addition, as shown in FIG. 16, a structural pattern 70, and the like, can form at least one opening 71 through a conformable device 20L in isolation from the inner volume of the conformable device for the ventilation of matter, e.g., liquids, and gases.

Figure 2:
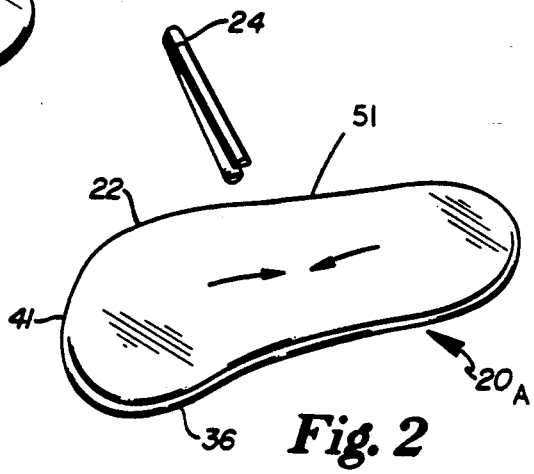
FIG. 2 is a perspective view of the conformable device of FIG. 1 after removal of the restraint and mixing of the two reagents.

As shown in FIG. 1, the interior compartment of a conformable device 20 is divided into two-parts **26*a* and 26*b*. A restraint 24 initially forms the two compartments and each is filled with a separate reagent 27*a*, and reagent 27*b* respectively. As shown in FIG. 2, when the restraint 24 is removed the enclosures 26*a*, 26*b* are placed in fluid communication and the reagents 27*a*, 27*b* are then free to mix and interact within the inner volume of the chamber 51 of conformable device 20*a*. The resulting conformable material 41 substantially comprising fluid matter then forms a resilient material substantially comprising solid matter after a working time. The preferred low viscosity desired of the reagents for this particular embodiment, and the like, facilitates their proper mixture, e.g., a viscosity of less than 200 poises. However, other viscosities can be used provided that the reagent(s) 27, or conformable material 41** can be made to adequately mix, or can otherwise be sufficiently exposed to a curing agent, or like physical phenomenon so as to comprise a resilient material after a working time.

Figure 5:
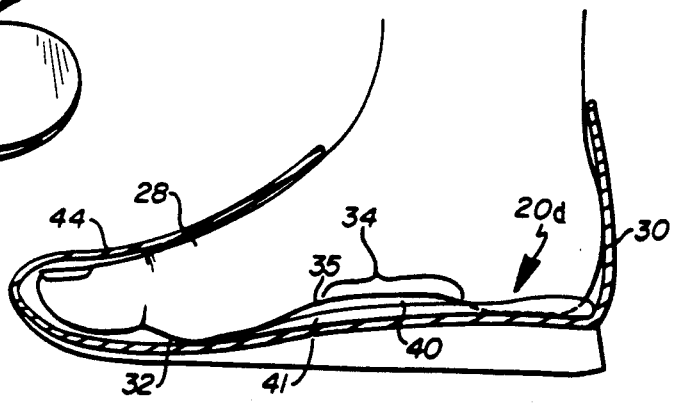
FIG. 5 is a medial view of a conformable device similar to FIG. 3 positioned in an article of footwear after the protective release material has been removed with parts broken away to show a foot in position.

As shown in FIG. 5, a wearer's foot "bottoms out" and is substantially supported in an article of footwear 44 upon a sockliner embodiment of conformable device **20*d* without substantial quantities of conformable material 41 being present under the heel 30 or ball of the foot 28. The conformable device 20*d*, thereby serves to substantially fill the gap(s) between the foot 28 and the supporting surface(s) within the article of footwear 44. In particular, the conformable device 20*d* substantially forms about the plantar side of the foot 28 from an area about the heel 30 to an area about, but rearward of the metatarsal heads 32 and provides support to the area of the arches 34, but without adversely affecting the fit of the foot 28 in relation to the article of footwear 44**.

A desired practical effect is to support and stabilize the wearer's rearfoot 37 during stance in or about the neutral position in association with an article of footwear 44. The use of a silicone elastomer can then be understood as returning the foot to something resembling the natural environment wherein the structure and function of the foot evolved, i.e., substantial contact, support and at least partial plantar encapsulation upon an accommodative surface. This desired state is commonly lost when an article of footwear 44 with inadequate conforming properties is donned and worn, e.g., on a hard, flat surface such as asphalt or cement.

It can be readily understood that some conformable materials can be better suited for a select embodiment of the present invention. For example, a preferred conformable material 41 for use in conformable device 20, as shown in FIG. 1, is a two-part room temperature cure silicone, e.g., Dow Corning HS II RTV, or 3110 RTV, Dow Corning Corporation, Midland, Mich., or General Electric RTV 11, General Electric Silicone Products Division, Waterford, N.Y., although other materials are contemplated. (For example: A preferred micro-cellular foam polyether urethane system with an approximate density in the range of 0.1 to 0.6 gram/cm 3 and suitable hardness could also be used.) Further, a water vapor cure silicone elastomer is suitable for conformable device **20*z*, as shown in FIG. 29**, and the like. However, it can be readily understood that a conformable material substantially consisting of fluid matter which forms a resilient material substantially consisting of solid matter after a working time for use in the present invention can be made from a material on materials related to the group of plastics, thermoplastics, polymers, copolymers, resins, natural and synthetic rubbers consisting of silicone, aqueous silicone emulsions, silicone gel, urethane, polyurethane, polyethylene, polycarbonate, polyvinyl chloride, propylene, polyamide, neoprene, nitrile, vinyl, nylon, polyester, styrene, butadiene acrylonitrils and etyrene rubbers, latex, other natural and synthetic rubbers, and the like.

In addition, it can be readily understood that a conformable material 41 can include at least one filler material to further reduce the density and weight by volume of the conformable material 41, or to otherwise influence the physical or mechanical properties of the conformable material 41 in a desired manner. Both organic and/or inorganic microspheres are suitable fillers, although other filler materials are also useable. For example, organic microspheres manufactured by the Kema-Nord Company, Sweden, with product designation EXPANCEL ® having a density in the range of 0.04 gram/cm3 can constitute a suitable and substantially inert lightweight filler in some preferred embodiments. Organic microspheres have elastic properties in addition to their low density. Commercially available organic microspheres are commonly composed of PVDC/AN (polyvinylidene chloride/acrylonitrile) copolymer, carbon, phenolic materials, and the like. Inorganic microspheres having select densities can also be used as a filler in various applications of the present invention and these include, e.g., SCOTCHLIGHT GLASS BUBBLES ®, manufactured by the 3M Company, and Z-LIGHT SPHERES ®, manufactured by Zeelan Industries, Inc., both of St. Paul, Minn. Commercially available inorganic microspheres are commonly composed of soda lime borosilicate, sodium borosilicate, silica, eluminosilicate, fly ash, perlite, ceramics, and the like. In contrast with organic microspheres, inorganic microspheres do not possess substantial elastic properties and they thus tend to more readily increase the overall hardness of an encapsulating resilient material. For this reason it is necessary to use a softer durometer elastomer or resilient material in conjunction with inorganic microspheres when a specific range of overall resultant hardness is desired. At least one foam material can be used in a plurality of portions as a filler material. Moreover, the use of at least one select foam material can also servo one or more other useful purposes, as discussed herein. In addition, various talks, cork material, and other natural or synthetic materials can be used as a filler material.

The inclusion of microspheres as a filler tends to increase the viscosity of the reagents in their liquid state and can make proper mixing of the reagents more difficult. For this reason, Dow Corning 200, or other reducing or thinning agents can sometimes be introduced to lower the viscosity of one or more reagents in order to facilitate proper mixing of the reagents forming a conformable material 41, and in particular, when a two part room temperature cure silicone such as Dow Corning 3110 is being used in the embodiment shown in FIG. 1, and the like. [Note: Dow Corning 200 substantially consists of a silicone fluid. General Electric Company (GE) also manufactures silicone fluids under the designation SF96 and the trademark VISOASIL ®. Silicone fluids are commercially available in a range of molecular weights and viscosities from 5 to in excess of 600,000 centistokes. The addition of a cross-linking agent to a silicone fluid can render the fluid a viable silicone reagent which can form a room temperature cure silicone gel, or other silicone material when placed in communication, mixed, or otherwise exposed to a suitable curing agent, or like physical phenomenon. It can then be readily understood that a silicone fluid can be caused to comprise a conformable material which forms a resilient material after a working time.] The use of thinning agents could be desired regardless of the inclusion of fillers and vice-versa. In some applications no thinning agents and no fillers are used. In other applications thinning agents can be used with or without fillers, and fillers can be used with or without thinning agents. Coloring agent(s) to indicate proper mixing of the reagents and associated conformable material can also be used.

Fillers which can be caused to be substantially enveloped, encapsulated, or suspended within a conformable material can also perform useful work regarding the attenuation of force applications and dampening of associated shock. Coloring agent(s) can also be used to indicate the select mechanical properties of the conformable material, or a conformable device.

The hardness of the resilient material to be used in a conformable device should be selected according to certain criteria. Generally, the preferred resilient material has a hardness in the range of 10–60 Shore A, although other Shore scales of hardness are commonly used in the industry, and other Shore scales can be more appropriate for use depending upon the nature of the resilient material selected for use in a particular application of the present invention. (Note, for example, Dow Corning RTV 3110 has a hardness of approximately 45 Shore A, and the use of reducing or thinning agents can further decrease the hardness of the cured resilient material.) Thus, the resilient material can at least partially attenuate force applications and dampen shock while at least partially conforming about a portion of the wearer's anatomy in relation to an article of footwear. Moreover, the physical and mechanical properties of a resilient material, e.g., hardness, shock-absorption, and so on, to be used in various alternate embodiments of a conformable device can be selectively determined. As shown in FIG. 5, conformable device **20*d* is used to customize a sockliner and could use a conformable material 41 that would cure, e.g., to a hardness of 25 Shore A. As shown in FIG. 18, conformable device 20*n* is used to customize an article of footwear 44 in the area the lateral malleollus 63 and could use a conformable material 41** that would cure, e.g., to a hardness of 45 Shore A, and so on.

Further, with regards to a two-part conformable material, the setting time of the reagents can be selected according to certain criteria. A working time of 5–15 minutes at room temperature is normally sufficient for the completion of necessary conforming and fitting procedures as described below. However, a longer working time could be suitable depending upon the particular materials being used and the particular application, e.g., a water vapor cure silicone elastomer normally requires a longer time period to set and/or cure. When using a conventional two-part room temperature cure silicone elastomer, the working time of the conformable material can be specifically regulated by proper selection(s) regarding the type(s), amount(s) and concentration(s) of the catalyst(s) being used. In some embodiments and applications, it can be desirable to use so-called "retarding" or "accelerating" co-catalysts or agents with the primary catalyst for forming the elastomer or resilient material.

An additional reason why a room temperature cure silicone is being used as a resilient material is the absence of a noticeable exothermic (heat-producing) chemical reaction. However, as shown in FIG. 5, it should be noted a personalized conformable device **20*d* can be placed within an article of footwear 44 in such a manner as to substantially insulate the wearer from any possible exotherm as a conformable material 41** would set and cure. In addition, severe health risks have not been associated with the use of silicone elastomers, in contrast, e.g., with many urethane and polyurethane materials. The use of a silicone elastomer can be readily understood as providing at least partial attenuation of force applications and dampening of shock, and improved comformance, fit, support, and comfort by at least partial conformance of a resilient material about a portion of a wearer's anatomy in relation to an article of footwear. This desired state is imperfectly achieved when an article of footwear is used which possesses less than optimal conforming properties.

Figure 3:
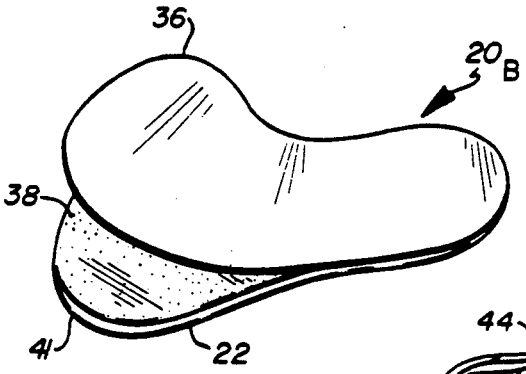
FIG. 3 is a perspective view of the conformable device of FIG. 2 showing the removal of a protective release material on the underside of the conformable device exposing a self-adhesive surface.

As shown in FIG. 3, one side (shown), or both sides (not shown) of conformable device **20*b* can employ a peel-away protective release material 36 that exposes self-adhesive surface 38. The preferred adhesive being used at the present time is a "pressure sensitive" product that permits removal and replacement of the preferred conformable device 20*b*** if ever necessary: SCOTCH-MOUNT ® double coated foam adhesive tapes manufactured by the 3M Company, St. Paul, MN., are being used at the present time, although other materials are contemplated. In particular, the preferred product is 3M tape No. 4484, a white polyethylene foam tape with a thickness approximately of 1/16th or 0.063 inches. Suitable materials and products must have a temperature resistance meeting or exceeding approximately 100–120 degrees Fahrenheit, demonstrats resistance to solvents, in particular water, and have high adhesive qualities. A foam tape with a thickness approximately of 0.031–0.063 is preferred for use with a conformable device in most embodiments in order to accommodate for irregularities between the surfaces to be joined. In some applications, a thinner double-coated adhesive tape can be used to affix a conformable device to an overlying material. Moreover, the 3M Company manufactures adhesive tapes having specific bonding characteristics with reference to the particular material surfaces to be affixed.

As shown in FIG. 5, a conformable device can be inserted or otherwise secured in relation to an article of footwear 44 which can then be donned by a wearer. The conformable material 41 within conformable device **20*d* will then form a resilient material after a working time and the conformable device 20*d*** will attain at least partial conformance about a portion of the wearer's anatomy, e.g., the plantar aspect of a wearer's foot.

As shown in FIG. 6, an overlying material 46 can be used as a structural wall of the conformable device **20*e*, or the casing 22 can alternatively be heat/pressure sealed, bonded, or otherwise affixed by conventional means to an overlying material 46 so as to create a one-piece unit 72 of the conformable device 20B and overlying material 46**.

In the practical application of any or all embodiments of the present invention different individual users will likely require different quantities of conformable material 41 in order to attain a desired conformance or fit. This phenomenon is due to the variation in anatomical features and characteristics which exists amongst the general public. This practical problem can be overcome by various devices, means, and methods associated with various alternate embodiments of a conformable device, as discussed below.

The quantity of conformable material present within a conformable device 41 intended for a particular use can be regulated during production so as to accommodate for volumes anticipated with respect to differing anatomical features and characteristics. For example, the amount of conformable material 41 present within a conformable device **20*d*, as shown in FIG. 5, and the like, can be regulated during production so as to accommodate for differing arch characteristics, and associated requisite volumes, i.e., high, normal and low arches or so-called flat feet. In addition, one or more different solid, liquid, gas, viscous material, or combination(s) thereof, can be used within alternate embodiments of a conformable device. The quantity and associated volume of the conformable material 41**, and any or all other materials or components used in a conformable device can similarly be substantially regulated or otherwise anticipated during production.

The use of foaming or blowing agent(s) with conformable material 41 would constitute another method to accommodate for varying anatomical features and characteristics, as different volumes can be displaced by a given quantity of a foamed or blown conformable material 41. Foaming or blowing agents can also serve to reduce the density and/or reduce the weight by volume of the resulting resilient material. Foaming or blowing agents are generally classified as physical, or chemical blowing agents. Physical blowing agents function as gas source by undergoing a change in a phase state. Suitable physical blowing agents are largely related to the group of aliphatic hydrocarbons and their chloro- and fluoro-derivatives comprising isomers of pentane, hexane, heptane, fluorocarbons, trichlorofluoromethane, dichlorodifluoromethane, dichlorotetrafluoroethane, monochlorodifluoromethane, methylene chloride; carbon dioxide, nitrogen, and the like. Chemical blowing agents produce gas by a chemical reaction. Suitable chemical blowing agents are largely related to the group comprising sodium bicarbonate, dinitrosopentamathylene-tetramine, sulfonyl hydrazides, azodicarbonamide, p-toluenesulfonyl semicarbazide, 5-phenyltetrazole, diisopropylhydrazodicarboxylate, sodium borohydrite, and the like. The thermal range of decomposition of many preferred commercial blowing agents can be lowered by the addition of activators or so-called kickers. Moreover, it should be noted that the presence of ordinary water serves as a foaming or blowing agent for many resilient materials, e.g., urethanes, and polyurethanes.

As shown in FIG. 11, the use of at least one appendage 50, and the like, in functional relation to a conformable device 20g can also substantially accomodate for the variations in volume associated with different anatomical features and characteristics found amongst a large percentage of the potential user population. An appendage 50 is generally formed by a pliable casing 22 which also forms at least one chamber 51 of conformable device 20g, and the like. When a conformable device 20g is positioned in an article of footwear 44 and an application of pressure is made upon the conformable device 20g when a portion of the wearer's anatomy is inserted and secured, a quantity of the conformable material 41 can be displaced between the chamber 51 and appendage 50. A known quantity of conformable material 41 (and possibly a quantity of one or more different useable solid, liquid, gas, viscous material, or combinations thereof), which is known to accomodate the largest volume approximately required for an individual user possessing a particular size can then be introduced within the inner volume of a conformable device 20g, and the like, during production. An appendage 50 can then permit at least partial displacement and removal of a quantity of the conformable material 41, or other material(s) contained within a chamber 51 of conformable device 20g, and the like, and thus serve to substantially accommodate individual wearers who would require lesser quantities. In some embodiments of the present invention conformable material 41, or other matter which is displaced into the appendage 51 comprises non-functional excess matter and the appendage 51 including any and all such matter can be excised, or otherwise removed from the chamber 51 of conformable device 20g, and be simply discarded. However, it can be readily understood that the conformable material 41, or other matter which is displaced between the chamber 51 and appendage 50 does not necessarily comprise so-called "excess" conformable material 41, or other matter in various alternate embodiments of the present invention. In brief, the conformable material 41, or other matter can be displaced into an appendage 50 which is selectively located with respect to the chamber 50 and an article of footwear 44 so as to accomodate for the anatomical variation present in the general public in a desired manner, thus comprising a "smart" conformable device 20L, as seen in FIG. 16, and the like. In brief, displaced conformable material 41 can serve a useful purpose in some embodiments of the present invention and need not comprise excess matter. Accordingly, it can be readily understood that a plurality of appendages of desired form and location can be used with alternate embodiments of a conformable device.

It can be readily understood that a conformable device can be pre-positioned or affixed within an article of equipment during manufacture. Further, as shown in FIG. 18, a conformable device **20*n*, and the like, can be positioned by a user within an article of footwear 44 via an access point 43 to a pocket or compartment 45 and/or secured by at least one other conventional affixing means, e.g., VELCRO® hook and pile 81**, zipper, snap, self-adhesive surface, and the like (not shown). Frictional mating surfaces and/or structural mating surfaces of desired shape can also be used to affix a conformable device in relation to an article of equipment, as well as combinations of the above, and other conventional means. In addition, it can be readily understood that an appendage can use at least one affixing surface to facilitate control of the inner volume of the appendage and/or to stabilize the appendage with respect to the conformable device and/or an article of footwear with which the conformable device is to be used.

Figure 27:
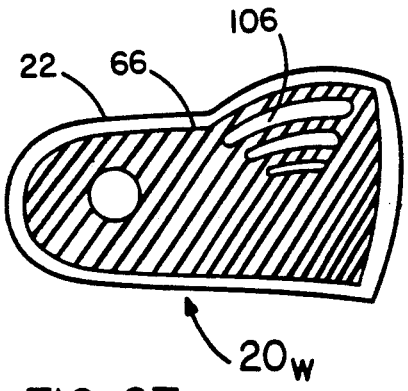
FIG. 27 is a top plan view of an alternate conformable device showing the use of a visco-elastic material, e.g., a silicone gel, in communication with the foam material contained within the conformable device.

As seen in FIG. 15, at least one select foam material 66 can be used within the inner volume of a conformable device 20K, and the like. Inclusion of a select foam material 66 can substantially reduce the overall density and/or weight by volume of a conformable device 20K and can at least partially determine the mechanical properties of a conformable device 20K. In addition, a foam material 66 can be formed to a desired shape, e.g., generally conforming to a portion of a potential user's anatomy, and can thereby selectively provide form and structure with regards to a conformable device 20K. Moreover, as shown in FIG. 27, a select foam material 66 can at least partially, or substantially, contain, encapsulate, or otherwise selectively define the placement of at least one other material, e.g., a silicone gel 106, used in conjunction with a foam material 66. Further, it can be readily understood that a select foam material can be configured to substantially direct the displacement of at least a portion of a conformable material 41 between an appendage 50 and chamber 51 of a conformable device.

Figure 28:
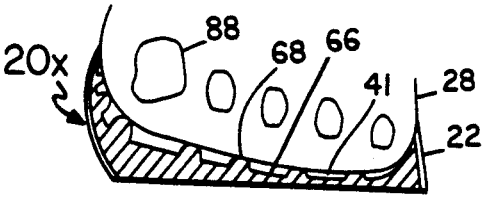
FIG. 28 is a cross-sectional view along the medial-to-lateral or transverse axis of the conformable device of FIG. 15, along line A—A.

In addition, it can be readily understood that the coordinated use of a select foam material 66 with a select conformable material 41 can produce a synergistic result and hybrid conformable device. As shown in FIG. 28, e.g., select mechanical properties can be exhibited by various portions of a conformable device 20X. For example, in one select cross-sectional area a stiffer foam material 66 might be used in greater proportion relative to a conformable material 41 which can be made to form a less stiff resilient material after a working time, whereas in another select area the proportions could be reversed. Further, the stiffness and other mechanical characteristics of the foam material 66 and resilient material could be just the opposite of those described above. Moreover, the configuration of a conformable device can also affect the mechanical properties exhibited in one or more portions. It can be readily understood that the teachings disclosed herein provide solutions to the need or desire to selectively "tune" the mechanical properties of a portion or portions of a conformable device.

The foam material 66 can be made from a material or materials related to the group of plastics, thermoplastics, polymers, copolymers, natural and synthetic rubbers forming substantially open and/or closed cell foams consisting of silicones, urethanes, polyurethanes (micro-cellular, ester, ether, reticulated), polyamide, melamine, polyethylene (linear, cross-linked), latex, neoprene, nitrile, polyvinyl chloride, ethylene vinyl acetate (EVA), other natural or synthetic materials, and the like. A foam material 66 can be surfaced, e.g., with a self-skin, embossed, laminated with a textile, laminated with a thermoplastic or polymer film, and/or treated with a primer or adhesive material. In addition, a foam material 66 can be selectively affixed to pliable casing 22 to at least partially define the form of a conformable device and selectively determine the mechanical properties exhibited in select areas of a conformable device. Further, as shown in FIG. 27, at least one different select foam material (not shown), or other form of matter can be at least partially embedded, encapsulated or otherwise used in communication with a select foam material 66 in conformable device 20W. In particular, a silicone gel 106, e.g., Dow Corning SYLGARD ® 527, and the like, can be embedded, or otherwise selectively utilized with the foam material 66 in a desired manner to provide for specific and select mechanical properties in at least one select area of a conformable device 20W, and the like. In addition, other viscous or visco-elastic materials, and/or solids, liquids, or gas(es), whether used alone, or in partial or complete combination, can be used for the same purpose within various alternate embodiments of a conformable device.

A relatively smooth-skinned or closed cell foam material is preferred for use within a conformable device because such materials maintain relatively low conformable device weight by preventing the penetration and absorption of the liquid reagent(s) or conformable material within the foam material. Relatively smooth surfaces on the foam material can facilitate cross-flow and proper mixing of the reagents, and at least partial envelopment and encapsulation of the foam material by a conformable material. However, relatively rough, textured, or otherwise irregular surfaces can facilitate the bonding or affixing of a foam material, e.g., to a member of a pliable casing, or other materials used in a conformable device. In an alternate embodiment, various open celled foam materials which permit select interpenetration and substantial encapsulation by a conformable material can be used.

As shown in a cross-sectional view of conformable device 20X in FIG. 28, a select foam material 66 can be formed, shaped, or heat/pressure molded using conventional techniques to exhibit raised contours 68 of desired configurations. It can be readily understood that a foam material 66 can be configured to generally enhance the fit and conformance of a conformable device; to enable proper mixing of the reagent(s) 27 or otherwise facilitate the setting and/or curing of a conformable material 41; and to permit at least partial envelopment and encapsulation of a foam material 66 by a conformable material 41. Accordingly, when conformable material 41 forms a resilient material substantially comprising solid matter after a working time, the foam material 66 is at least partially "entrapped" and encapsulated by the resilient material, thus causing the impression or shape molded in approximate conformance with a portion of a wearer's anatony to be at least partially, if not substantially retained.

In addition, the select shape of a foam material and the design of a conformable device in which the foam material is to be used can determine in part or whole the mechanical properties exhibited by a conformable device. The mechanical properties of a conformable device can be further determined by the coordinated use of a select conformable material which can be made to form a resilient material after a working time with a select foam material, as discussed above. In a preferred embodiment of a conformable device it can then be readily understood that the use of at least one foam material of desired shape, a conformable material forming a resilient material substantially comprising solid matter after a working time, and the design of a conformable device can be coordinated in such a manner to optimize the mechanical properties and other desired features of a conformable device. Again, a conformable device can employ an individual chamber, a plurality of chambers which are in continuous fluid communication, or a plurality of isolated and independent chambers containing different conformable material(s), (and other solid, liquid, gas, or viscous materials, or combinations thereof), which can exhibit various desired and select mechanical properties as between at least two portions of a conformable device. It can then be readily understood that select materials, construction features, and design of a conformable device are coordinated in such as manner to yield desired mechanical properties in select portions of a conformable device for use in an article of footwear.

Figure 4:
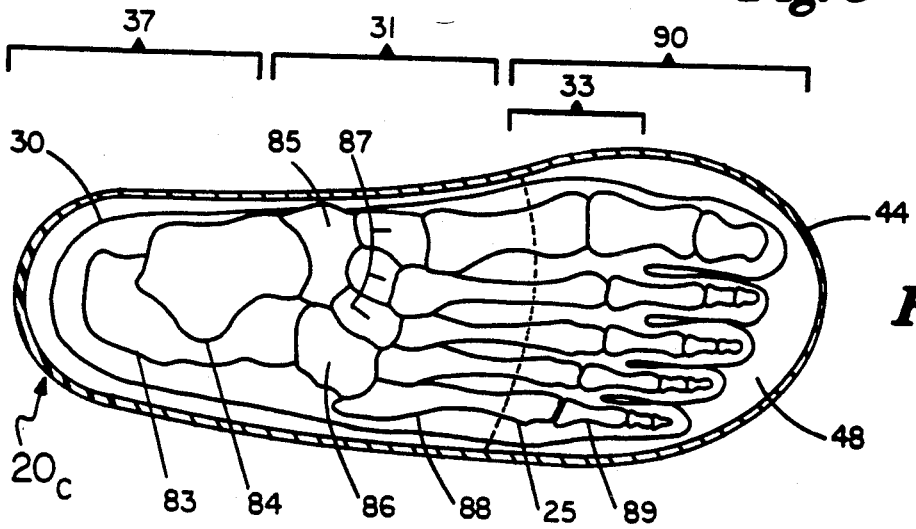
FIG. 4 is a superior plan view of a conformable device for use in the area of the footbed of an article of footwear showing the position of the conformable device in relations to various bones of a wearer's foot.

In FIG. 4, the bones of a wearer's foot are shown in relation to conformable device **20*c* which is similar in general shape to the conformable devices shown, e.g., in FIGS. 3 and 4, As shown in FIG. 5, a conformable device 20*d* for use as a sockliner, or midsale component can include at least one gas which can be located within at least one void 40. When left unrestrained, enclosed gas(es) will naturally tend to rise to the highest point(s) within the inner volume of the chamber 51 of conformable device 20*d*. As shown in FIG. 5, this will generally correspond to the area about the apex 35 of the arch(es) 34 when the conformable device 20*d* is secured in an article of footwear 44 and conforms about a wearer's foot 28. The entrapped gas(es) or "air cushion" located within one or more voids 40 within a conformable device 20*d* can thereby help accommodate the dynamic flexion of the arch(es) 34**. In addition, a void can be formed by a specially designed structure, or enclosure to ensure proper containment of an entrapped gas (not shown). Further, it can be readily understood that the use of a foaming or blowing agent can produce a plurality of open or closed cells containing a gas with reference to a parent resilient material. Again, the inclusion of entrapped gas(es) can serve to reduce the weight by volume of a conformable device, aid in support and cushioning, aid in heat dissipation, serve as a foaming or blowing agent, or otherwise positively affect the course of the chemical reaction(s) and quality of a the conformable material which forms a resilient material substantially comprising solid matter after a working time.

Figure 7:
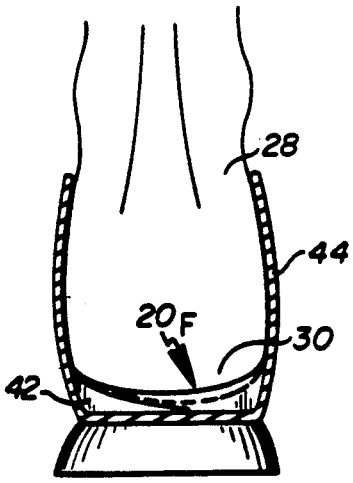
FIG. 7 is a rear cross-sectional view of an article of footwear showing a corrective post or wedge being used in conjunction with the conformable device of FIG. 5.
Figure 8:
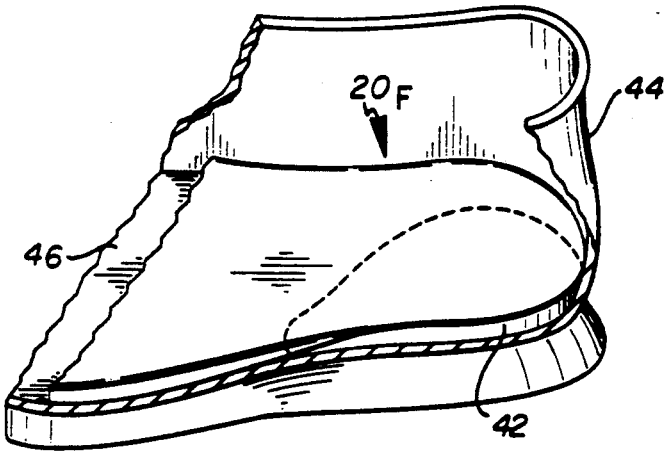
FIG. 8 is a perspective view of the corrective post or wedge of FIG. 7 used in conjunction with the conformable device of FIG. 5 within an article of footwear with parts broken away.

Referring to FIGS. 7 and 8, it is also possible to introduce corrective posts or "wedges" 42 in conjunction with a conformable device **20*f*, and the like, in order to rectify podiatric deviations that would fall outside the norm, e.g., potential and actual injurious conditions of eversion, inversion, varus, and valgus. These posts or "wedges" 42 can be manufactured to specified degrees of correction for the article of footwear 44 in which the application would be made. Again, a protective release material 36 can be removed from the posts or "wedges" 42 to expose a self-adhesive surface 38 for securing the posts or wedges 42** in place. The introduction of such corrective devices should be undertaken at the direction and with the supervision of a skilled and knowledgeable podiatrist or other medical doctor.

Figure 9:
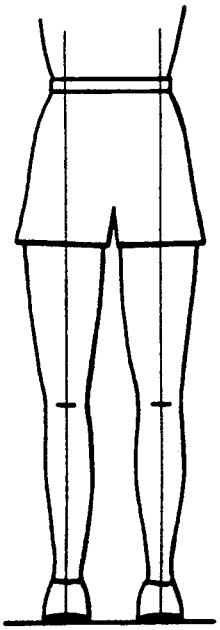
FIG. 9 is a front view of an individual showing proper bodily alignment in a standing neutral position.
Figure 10:
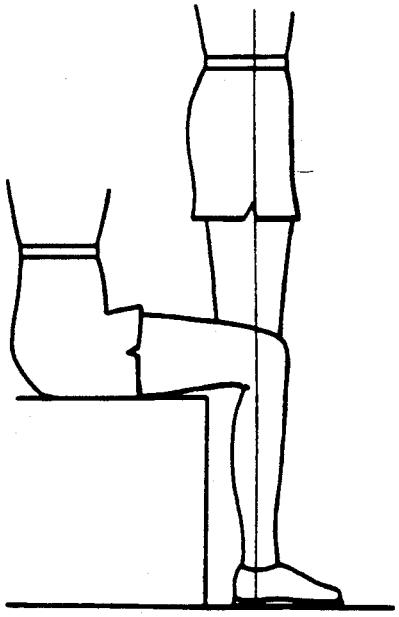
FIG. 10 is a side view of an individual demonstrating proper bodily alignment in standing and sitting neutral positions.

FIG. 9 is a prior art anterior view representation of a wearer of an article of footwear standing in or about the neutral position. FIG. 10 is a prior art side view of a wearer of an article of footwear standing or sitting in or about the neutral position.

As shown in FIG. 12, appendage 50 can utilize a restraint 24, e.g., a removable pin, to selectively isolate reagents 27*a*, and 27*b* within enclosures 26*a*, and 26*b* in reservoir 64 of conformable device 20*h*. A like restraint 24 can the be used to isolate the appendage 50 from the chamber 51 of conformable device 20*h*.

As shown in FIG. 12*a*, a patch 61 having a self-adhesive surface 38 can be used to close an opening produced in the casing 22 of a conformable device if and when an appendage 50 is excised.

Figure 13:
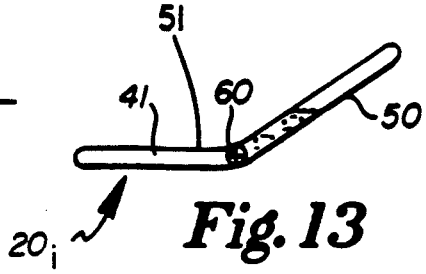
FIG. 13 is a cross sectional view of an alternate conformable device similar to that shown in FIG. 11 further including the use of a value device to aid in the control of resilient material displaced between the appendage and chamber of the conformable device with parts broken away to show the contents of the conformable device.

As shown in FIG. 13, a valve device 60 can be used within the conformable device 20*i* to control the displacement of the conformable material 41 between the appendage 50 and chamber 51 of conformable device 20*i*.

As shown in FIG. 14, an alternate embodiment of conformable device 20*j* employs at least one internal breakable enclosure(s) 62, whether free-floating, or affixed to the perimeter 23 of the casing 22. The internal breakable enclosures 62 can be ruptured by selective application of pressure to place reagents 27*a*, and 27*b* in fluid communication within the inner volume of conformable device 20*j*, whereby the reagents 27*a*, and 27*b* can be mixed to form a conformable material 41 substantially forming a resilient material after a working time. Separation of various reagents 27 or other materials can help promote chemical stability, thus product integrity and shelf life. Multiple sites for a reagent 27, e.g., a catalyst, can also aid in proper mixing of the reagents 27 forming a conformable material 41.

As shown in FIG. 15, a select foam material 66 of desired shape can be used within a conformable device 20*k*. Again, the foam material 66 can provide structure, at least partially determine the select mechanical properties exhibited in various portions of conformable device 20*k*, influence the weight by volume of conformable device 20*k*, and/or form a hybrid conformable device 20*k* for the attenuation of force applications and shock when used in select combination and coordination with a select conformable material 41 which forms a resilient material substantially comprising solid matter after a working time.

As shown in FIG. 16, at least one pre-formed structural pattern 70 can be contained within the inner volume of the chamber 51 of conformable device 20L, and the like, or a like structural patterns 70 can be formed by selectively heat/pressure sealing, bonding, or otherwise affixing opposing members of the pliable casing 22 using conventional means. A structural pattern 70 can help to selectively direct the placement of the conformable material 41 which comprises a resilient material after a working time and thereby enhance the conformance, support and stability of conformable device 20L in relation to an article of footwear 44. In addition, the structural pattern 70 shown in FIG. 16 can form at least one opening 71 that will permit the ventilation of matter through conformable device 20L, and the like, in isolation from the inner volume of conformable device 20L. This can enable, e.g., evaporation of bodily fluids and thereby aid in heat dissipation, but also aid in subsequent washing and drying of an article of footwear 44.

As shown in FIG. 17, an overlying sockliner 46 is used as a structural member of conformable device 20*m*, or alternatively, the casing 22 can be heat/pressure sealed, bonded, or otherwise affixed to the sockliner 46 so as to create a one-piece unit 72 of the conformable device 20*m* and sockliner 46.

As shown in FIG. 18, an access point 43 to a pocket or compartment 45 can utilize conventional closure means, e.g., VELCO® 81, or adhesive, zipper, (not shown), for locating a conformable device 20N in functional relation to the inner boot 107, or liner of a skate or ski boot, and the like.

Figure 19:
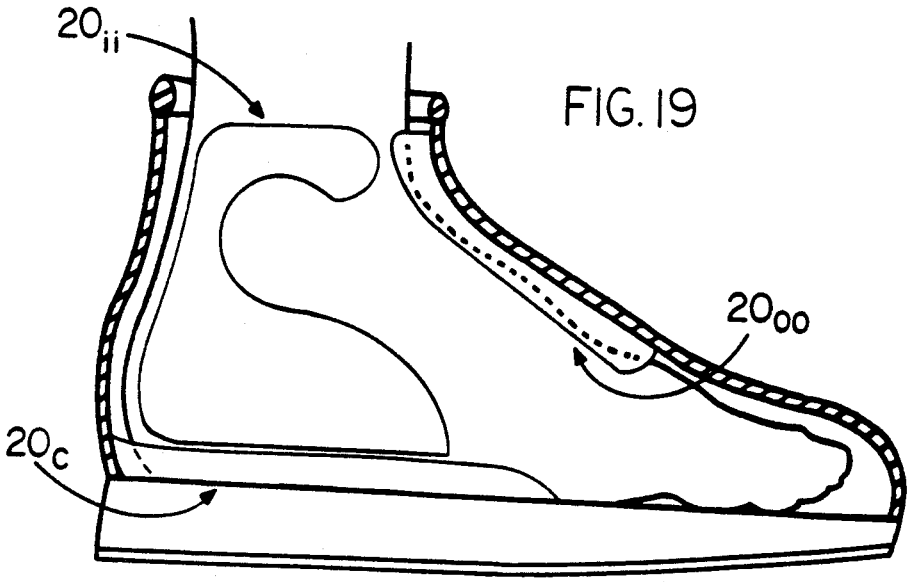
FIG. 19 is a lateral sectional view of a high-top article of footwear showing the use of various conformable devices.

As shown in FIG. 19, numerous conformable devices can be utilized in various portions of an article of footwear.

Figure 20:
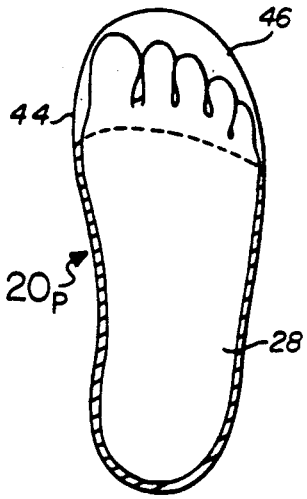
FIG. 20 is a top cross-sectional view of a conformable device formed about a wearer's foot in an article of footwear.

As shown in FIG. 20, a top cross-sectional view of a conformable device 20*p* shows a customized fit about the contours of the wearer's foot within an article of footwear.

Figure 21:
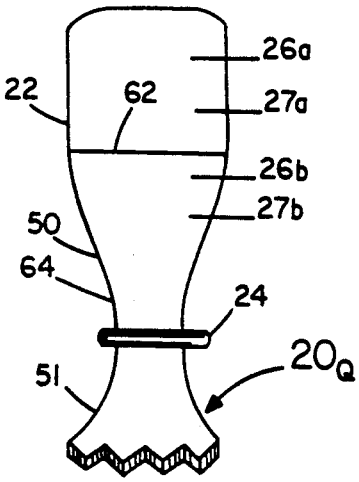
FIG. 21 is a plan view of an alternate conformable device showing an appendage separated by a restraint from the chamber of the conformable device, and a breakable enclosure separating the appendage into two portions for the separation of reagents.

As shown in FIG. 21, at least one internal breakable enclosure 62 forming at least one enclosure 26*b* can be used within the reservoir 64 of appendage 50 to selectively isolate reagent 27*b*. A breakable enclosure 62 can then be ruptured and reagent 27*b* can then be made to mix with reagent 27*a* to form conformable material 41. A restraint 24, e.g., a removable pin, can be used to further isolate the appendage 50 from the chamber 51 of conformable device 20*q*.

Figure 22:
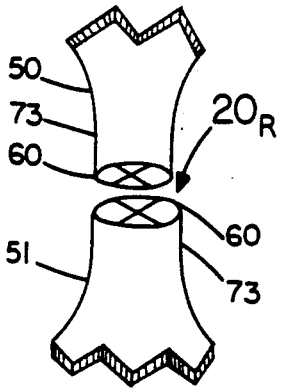
FIG. 22 is a perspective view of removably attachable appendage including coupling and valve devices to selectively isolate the appendage and chamber of a conformable device.

As shown in FIG. 22, an appendage 50 can be removably attached to the chamber 51 of conformable device 20*r* by the use of at least one coupling member forming a coupling device 73. In addition, coupling device 73 can comprise a valve device 60 for selectively permitting fluid communication between the appendage 50 and the chamber 51 of conformable device 20*r*. The valve device 60 can be actuated when at least one coupling member forming coupling device 73 is secured, or alternatively, by independent action.

Figure 23:
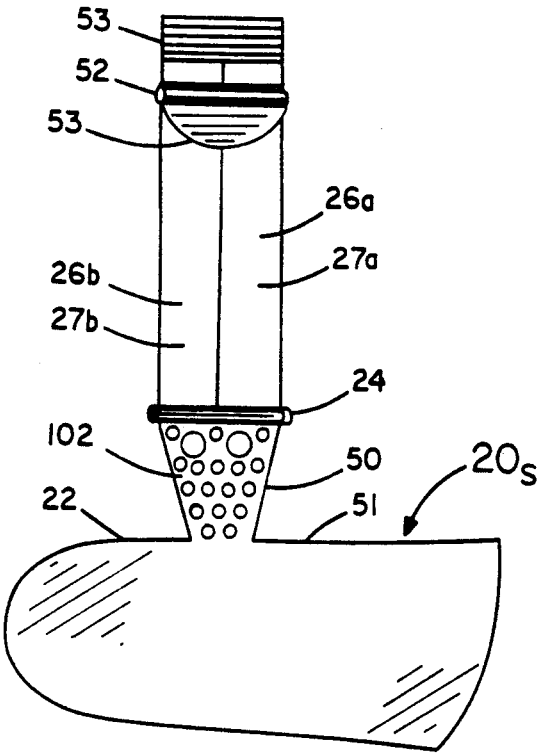
FIG. 23 is a perspective view of an alternate conformable device showing the use of a mixing and injection clip, at least one grip, a restraint, and a static mixing structure.

As shown in FIG. 23, an alternate appendage 50 can use a restraint 24 to selectively isolate reagents 27*a*, 27*b* in substantially parallel enclosures 26*a*, 26*b* formed by a pliable casing 22, or other barrier material. When restraint 24 is removed the reagents 27*a*, and 27*b* are placed in fluid communication and can be mixed and displaced through static mixing structure 102 by movement of mixing and injection clip 52. In addition, grip(s) 53 can be provided on the appendage 50 and injection clip 52. The appendage 50 can be formed in continuity with the chamber 51 of conformable device 20*s*, or be removably attached (not shown).

Figure 24:
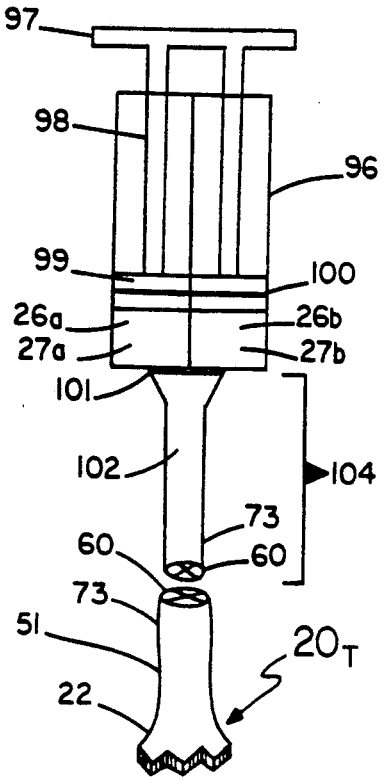
FIG. 24 is a plan view of an alternature conformable device showing the use of a container for selectively isolating one or more reagents and selectively mixing and displacing a conformable material between the container and the chamber of the conformable device.

As shown in FIG. 24, a container 96 can be used to selectively separate one or more reagents 27*a*, 27*b* and selectively place the reagents 27*a*, 27*b* in fluid communication. Depression of a plunger 97 actuates push rods 98 and pistons 99. The resulting pressure placed upon reagents 27*a*, 27*b*, isolated within enclosures 26*a*, 26*b* will result in the rupture of seal 101, thus placing the reagents 27*a*, 27*b* in fluid communication enabling their proper mixture as reagents 27*a*, and 27*b* are displaced through the static mixing structure 102 located in the dispensing tube 104 of container 96. An alternate embodiment would locate the dispensing tube 104 and/or static mixing structure 102 within the chamber 51 of a conformable device (not shown). The container 96 is fitted with a coupling member on the end of the dispensing tube 104 suitable for acting with an associated coupling member, thus forming a coupling device 73, whereby the container 96 and the chamber 51 of conformable device **20*t* can be placed in fluid communication. A valve device 60 selectively permitting fluid communication between the container 96 and the chamber 51 of the conformable device 20*t* can be actuated by the coupling device 73 associated with the container 96 and chamber 51 of the conformable device 20*t***, or alternatively, by independent operation. In general, suitable conventional means with regards to combination a valve and coupling devices are illustrated, e.g., by those used in the paint industry with reference to compressed air lines, but also quick attachment hydraulic lines, and so on.

Figure 25:
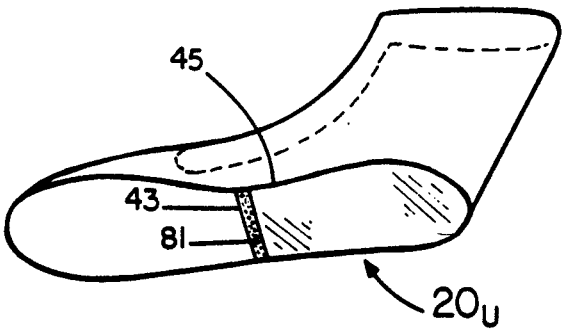
FIG. 25 is a perspective view of a conformable device used in functional relation with the inner boot or liner of an article of footwear showing a compartment for positioning of the conformable device and closure means.

As shown in FIG. 25, a conformable device **20*u* can be used in relation to the inner boot or liner of an article of footwear. Various convention means of affixing and positioning conformable device 20*u* can be used, including, but not limited to VELCRO ® 81. In addition, the conformable device 20*u* can be positioned in a pocket or compartment 45 via an access point 43. Obviously, the point of access and positioning of a compartment 45** would be a design choice within the scope of the present invention.

As shown in FIG. 27, a different material, e.g., a silicone gel 106, can be used in communication with a foam material 66 within an alternate conformable device **20*u***.

Figure 30:
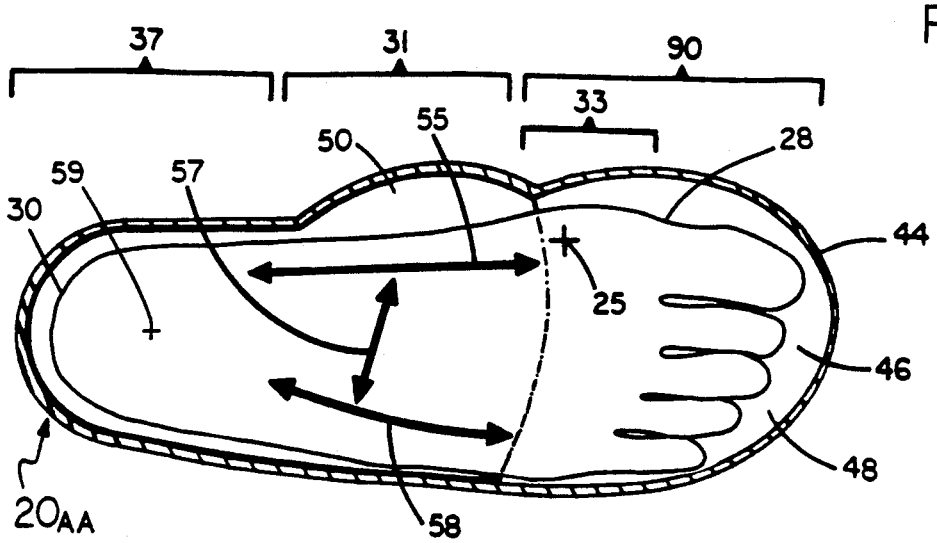
FIG. 30 is a superior plan view of a conformable device for use in an article of footwear similar to that shown in FIG. 4, but with the addition of an appendage.

As shown in FIG. 30, a conformable device **20*aa* for customizing the sockliner 46 of an article of footwear 44 at least partially underlies the planter aspect of a wearer's foot 28, in particular, the area underlying the rearfoot 37 and midfoot 31, thus providing substantial support to the arch(es) 34 of the foot 28. The wearer's foot 28 then substantially "bottoms out" and is supported in an article of footwear 44 without substantial quantities of conformable material 41 being present in the area underlying the tubercles of the calcaneus 59 of the heel 30 or the metatarsal heads 25 located in the ball 33 of the foot 28. The fit of the wearer's foot in relation to the substantially form-defining last of the article of footwear is thereby not adversely affected. Also shown in FIG. 30, are the area(s) of the, rearfoot 37, midfoot 31, ball of the foot 33, and forefoot 90. Conformable device 20*aa* of FIG. 30 also includes an appendage 50 located about the medial aspect of the midfoot 31. It can be readily understood that a plurality of appendages of desired form and location can be used with various embodiments of a conformable device, and a plurality of smaller appendages can be contained within a larger appendage. In addition, the areas substantially corresponding to the medial longitudinal arch 55, lateral longitudinal arch 58, and transverse arch 57 are also shown in FIG. 30**.

Figure 31:
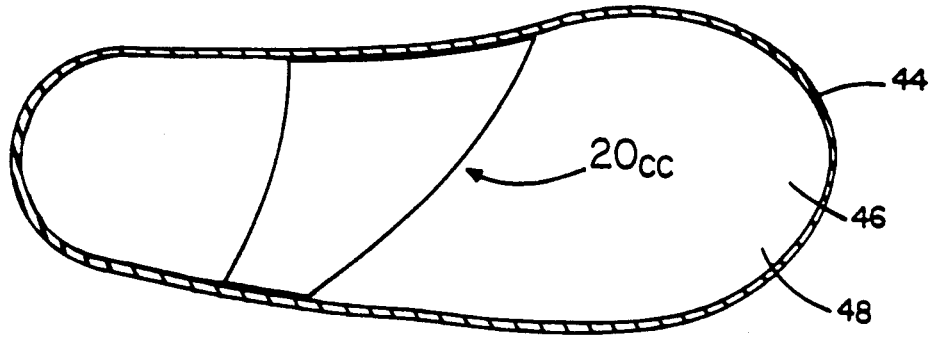
FIG. 31 is a superior plan view of an alternate conformable device for use in the area underlying the medial longitudinal, lateral longitudinal, and transverse arches of a wearer's foot.

As shown in FIG. 31, a conformable device **20*cc* can be used at least in part in a portion of a sockliner 46 or area of the footbed 48 and can support at least a portion of the wearer's medial longitudinal arch 55, lateral longitudinal arch 58, and transverse arch 57. An alternate embodiment of a conformable device 20*cc* can be used with at least one strap (not shown), and the like, for providing conformance or fit, supporting, stabilizing, or securing the area of the midfoot 31, and/or for the purpose of limiting eversion or inversion of the wearer's foot 28**.

Figure 32:
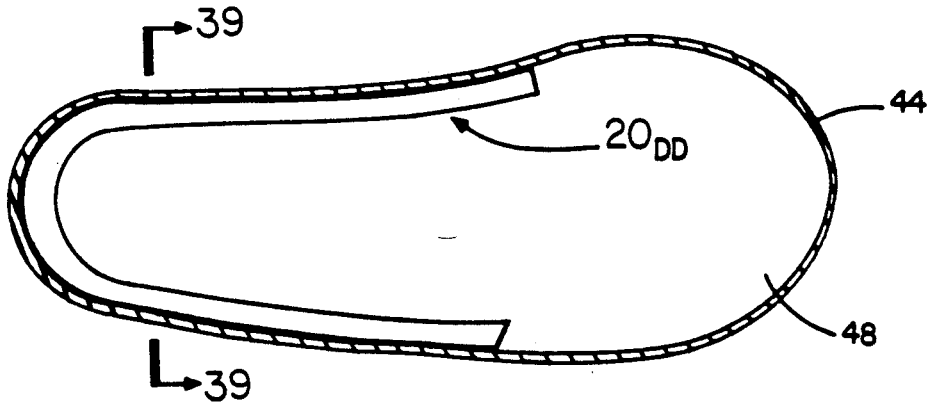
FIG. 32 is a superior plan view of a conformable device for use about the inferior aspect of the medial, posterior, and lateral perimeter of a wearer's foot.

As shown in FIG. 32, a conformable device **20*dd* can be used about the medial, lateral, and posterior perimeter of the inferior aspect of a wearer's foot 28. It can be readily understood that an alternate conformable device 20*dd* can be used about a portion or portions of the medial, lateral, end posterior perimeter of the inferior aspect of the wearer's foot 28, whether in partial or complete combination. Further, an alternate conformable device 20*dd* can exhibit symmetry or asymmetry between medial and lateral sides. Conformable device 20*dd*, and the like, can provide support to and enhance the stability of a wearer's foot 28 within an article of footwear 44. In addition, a conformable device 20*dd***, and the like, can provide enhanced conformance or fit.

Figure 33:
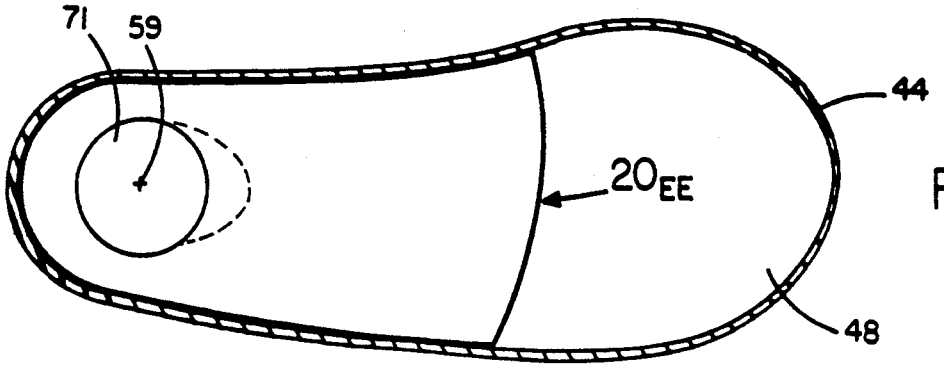
FIG. 33 is a superior plan view of a conformable device for use in the footbed of an article of footwear showing an opening in the area about the plantar aspect of a wearer's heel.

As shown in FIG. 33, a conformable device **20*ee* can have an opening 71 in the area about the inferior or plantar aspect of a wearer's heel 30 centered approximately beneath the tubercles of the calcaneus 59 enabling the wearer's heel 30 to be positioned proximate to an underlying and supporting surface within an article of footwear 44. This configuration can contribute to positioning and stabilizing the wearer's rearfoot 37 in relation to an article of footwear 44**. Further, this configuration can accomplish these tasks without further elevating the wearer's heel.

Figure 34:
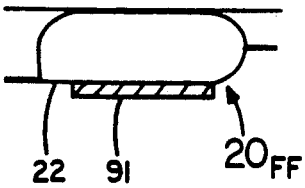
FIG. 34 is a cross-sectional view of a representation of a conformable device showing several different configurations for mating, or bridging opposing members of pliable casing.

As shown in FIG. 34, different configurations for joining opposing members of pliable casing 22, and/or for joining members of pliable casing 22 to at least one overlying material 91 can be used to form different structural embodiments of a comformable device **20*ff*. At the top position is shown two opposed members of a pliable casing 22 joined to a third approximately perpendicular member of a pliable casing 22. At the bottom position is shown two opposed members of a pliable casing 22 joined to a third approximately perpendicular member of overlying material 91. At the right position is shown two opposed and equilateral tapering members of a pliable casing 22 joined in a symmetrical manner. At the left position is shown two substantially opposed members of a pliable casing 22, the first member remaining substantially within one plane and the second member of the pliable casing 22 tapering so as to join the first member of the pliable casing 22. These representative configurations for substantially enclosing a conformable device 20*ff* do not exhaust the possible alternative embodiments, but are shown to demonstrate possible designs and methods of fabricating a conformable device 20*ff***.

Figure 35:
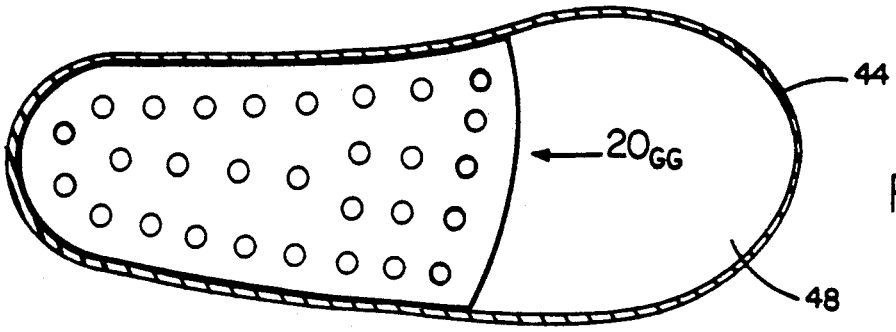
FIG. 35 is a superior plan view of a conformable device showing opposing members of pliable casing joined in a symmetric structural pattern.

As shown in FIG. 35, at least one symmetrical structural pattern 70 can be used to substantially define the form and selective reinforcement of conformable device **20*gg*, and the like. A symmetrical structural pattern 70 can serve aesthetic purposes, and/or the purpose of economy with respect to the selective reinforcement of a conformable device 20*gg***.

Figure 36:
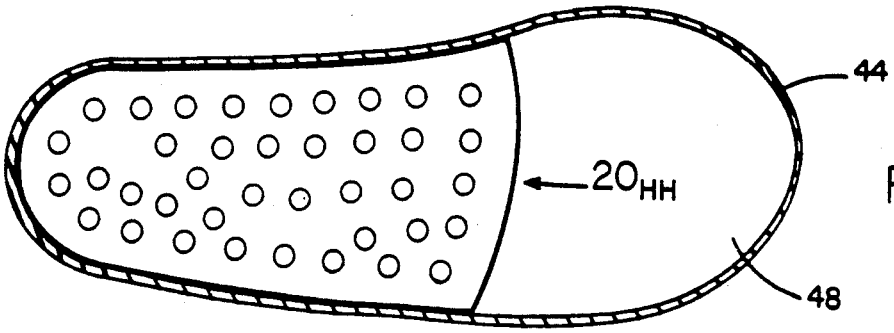
FIG. 36 is a superior plan view of a conformable device showing opposing members of pliable casing joined in an asymmetric structural pattern.

As shown in FIG. 36, asymmetrical structural patterns 70 can be used in defining the form and selective reinforcement of conformable device **20*hh*, and the like. Asymmetrical structural patterns 70 can be used in recognition of the fact that applications of force upon the conformable device 20*hh* can be non-uniformly or asymmetrically applied to a portion or portions of a conformable device 20*hh*, thus possibly necessitating non-uniform or an asymmetrical structural pattern 70 for selective reinforcement a conformable device 20*hh***.

Figure 37:
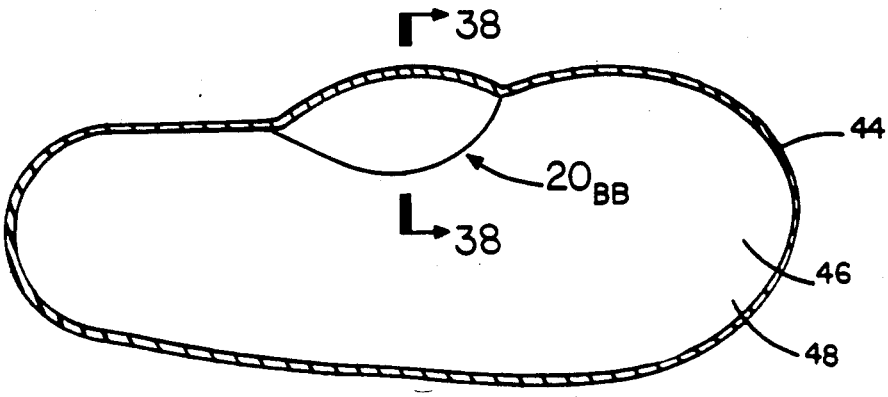
FIG. 37 is a superior plan view of a conformable device supporting at least one arch of a wearer's foot.

As shown in FIG. 37, a conformable device 20*bb* can be used in a select area of a sockliner 46 or area of the footbed 48 of an article of footwear 44. Conformable device 20*bb* can substantially support at least a portion of the wearer's medial longitudinal arch 55 and transverse arch 57, and if desired, at least a portion of the medial aspect of the area of the midfoot 31.

Figure 38:
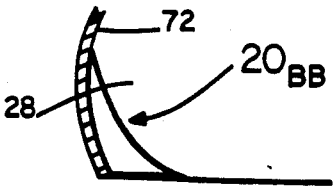
FIG. 38 is a cross-sectional view along the medial-to-lateral or transverse axis of the conformable device of FIG. 37, along line B—B.

As shown in FIG. 38, a cross-sectional view of the conformable device 20*bb* of FIG. 37 along line B—B shows support to the area about a portion of the medial longitudinal arch 55 of a wearer in the area of the midfoot 31 and the presence of the conformable device 20*bb* about a portion of the medial aspect of the wearer's foot 28 forming a substantially cupped formation. This can enhance conformance or fit, comfort, and support to the medial aspect of the foot, and thereby, at least partially limit aversion of the wearer's foot 28.

Figure 39:
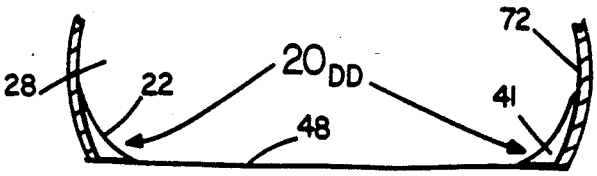
FIG. 39 is a cross-sectional view along the medial-to-lateral or transverse axis of the conformable device of FIG. 32, along line C—C.

As shown in FIG. 39, a cross-sectional view of the conformable device 20*dd* of FIG. 32 along line C—C shows substantially cupped formations about the medial and lateral inferior perimeter of a wearer's foot 28. Again, this can enhance conformance or fit, comfort, and support to both the medial and lateral aspects of the foot thereby at least partially limit eversion and inversion of the wearer's foot 28.

As shown in FIG. 40, a conformable device 20*ii* can be used to enhance conformance or fit, and support to the lateral aspect of a wearer's foot 28 in the area about the lateral malleolus 63. Conformable device 20*ii* can then protect the wearer in the area of the lateral malleolus 63 from direct force applications, and aid in limiting injury resulting from inversion of the foot 28 to the lateral collateral ligament(s), i.e., the anterior talofibular ligament, the posterior talofibular ligament and the calceneofibular ligament.

As shown in FIG. 41, a conformable device 20*jj* can be used to enhance conformance or fit and support to the medial aspect of a wearer's foot 28 in the area about the medial malleolus 65. Conformable device 20*jj* can then help protect the wearer from a direct force applications in the area about the medial malleolus 65, and aid in limiting injury resulting from eversion of the foot 28 to members of the deltoid ligament(s), i.e., the anterior tibiotalar, posterior tibiotalar, tibiocalcaneal, and tibionavicular ligaments.

As shown in FIG. 42, a superimposed view of the conformable devices 20*ii* and 20*jj* of FIGS. 40 and 41 shows the presence of asymmetry between the lateral and medial embodiments of the conformable devices 20*ii* and 20*jj*. The center of the medial malleolar protuberance is typically 2 centimeters anterior and approximately 2.5 centimeters superior to the center of the lateral malleolar protuberance in an adult wearing a size 9 article of footwear. (See John Robinson, et. al., U.S. Pat. No. 4,876,806.) Allowance for medial and lateral asymmetry in the configuration of conformable devices 20*ii* and 20*jj* can enhance conformance or fit.

Figure 43:
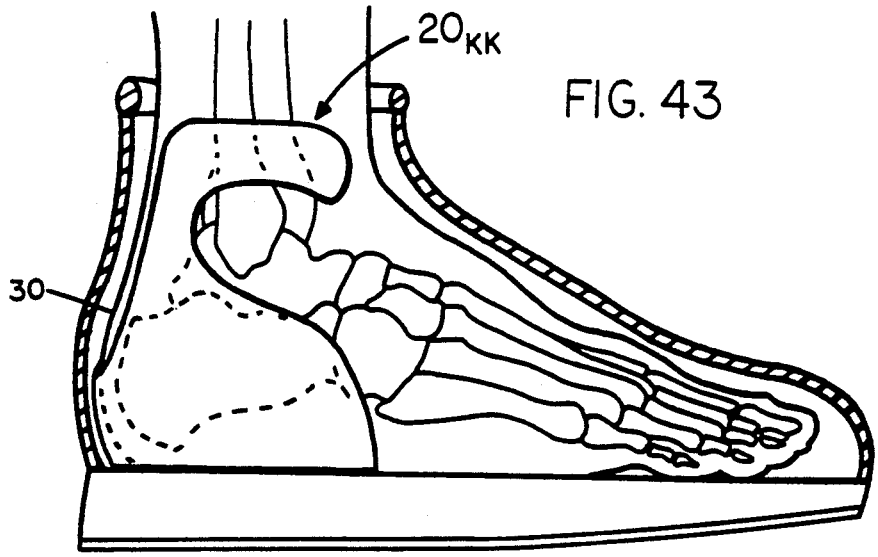
FIG. 43 is a lateral view of a single conformable device similar to a combination of FIGS. 40 and 41, as shown in FIG. 42, but showing continuity about the heel of the wearer's foot, thus permitting fluid communication between lateral and medial aspects of the conformable device.

As shown in FIG. 43, a conformable device 20*kk* similar to FIGS. 42 can be formed in a single unit and used in continuity about the posterior aspect of the heel 30 of a wearer's foot 28, or other foot portion, thus permitting fluid communication between lateral and medial sides of a conformable device 20*kk*. This can enhance conformance and fit about the area of the wearer's heel 30 and thereby compliment the stability provided by conventional heel counters. In some cases, a wearer might consider that this construction would render the use of a conventional heel counter unnecessary. It can be readily understood that other embodiments of the present invention can enhance conformance or fit and provide support and stability to other portions of the wearer's foot with respect to other conventional footwear constructions.

Figure 44:
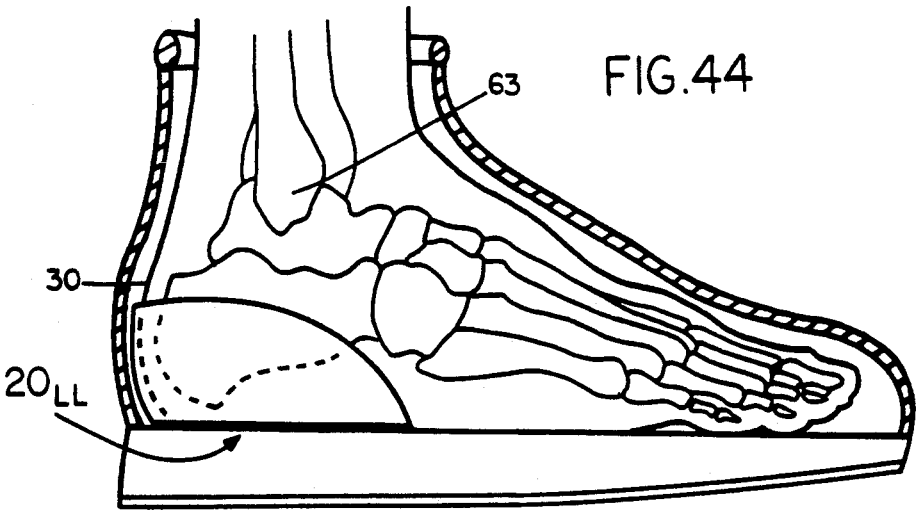
FIG. 44 is a lateral view of an alternate embodiment of a conformable device for use in the area substantially inferior to the lateral malleolus.

As shown in FIG. 44, a conformable device 20LL can be used about the area largely inferior to the lateral malleolus 63 and/or medial malleolus 65 for enhancing conformance or fit, support and stability about the area of the wearer's heel 30.

Figure 45:
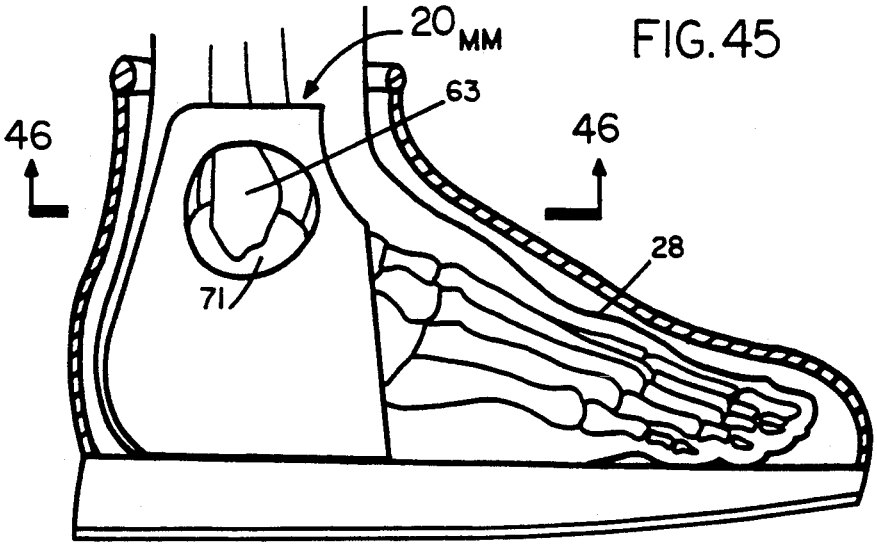
FIG. 45 is a lateral view of an alternate embodiment of a conformable device showing an opening substantially encompassing the lateral malleolus.

As shown in FIG. 45, a conformable device 20*mm* can form an opening 71 in the area about the lateral malleolus 63, and medial malleolus (not shown) for providing conformance or fit and support and stability while substantially permitting plantar and dorsi flexion of the wearer's foot 28.

As shown in FIG. 46, a cross-sectional view of the conformable device 20*mm* of FIG. 45 along line D—D shows substantial encompassing of the lateral malleolus 63 by the conformable device 20*mm*.

Shown in FIG. 47, is a lateral view of a conformable device 20*nn* which is suitable for use, e.g., in a non-conventional footwear tongue, or a footwear upper 72 for basketball shoes, skates or ski boots. A notched area 75 in conformable device 20*nn* is shown about the distal and anterior aspect of the wearer's leg 76 and superior aspect of the foot 28 anterior to the lateral malleolus 63, and medial malleolus 65, thus permitting substantial plantar and dorsi flexion of the foot 28. In particular, the notched area 75 relieves possible force applications that would otherwise be applied to substantially tendonous tissue, e.g., of the tibialis anterior, extensor digitorum longus, and extensor hallucis longus in an area about the superior and inferior extensor retinaculum(s) (not shown), and thereby, possible restriction of the wearer's range of motion during plantar and dorsi flexion.

As shown in FIG. 48, a conformable device 20*oo* can be used in a convention footwear tongue 77 for the purpose of enhancing fit and diminishing localized pressure upon the dorsal or superior aspect of the wearer's foot 28 when conventional shoe laces or other closure devices are used to secure the article of footwear 44 about the wearer's foot 28.

FIG. 49, is a cross-sectional view of conformable device 20*k* shown in FIG. 15, showing a relieved area underlying and accommodating the resting plantar profile, but also the protrusion of the plantar fascia during physical activity.

FIG. 50 is a representation of an open-celled foam material 66 for use with an embodiment of the present invention showing substantial intercommunication of adjoining cells 78.

FIG. 51 is a cross-sectional representation of the penetration of a conformable material 41 with respect to an open-celled foam material 66.

Figure 52:
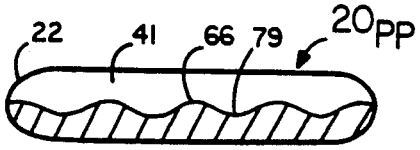
FIG. 52 is a cross-sectional view of a conformable device showing a foam material affixed to one side of a pliable casing and the presence of resilient material.

FIG. 52 shows a cross-sectional view of a representation of a conformable device 20*pp* having a foam material 66 affixed to one side of a pliable casing 22 with the presence of conformable material 41 in peaks and valleys 79 formed upon the foam material 66.

Figure 53:
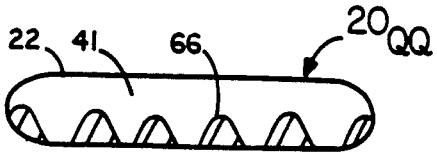
FIG. 53 is a cross-sectional view of a conformable device showing separated foam material members affixed to one side of a pliable casing and the presence of resilient material between the foam material members.

FIG. 53 shows a cross-sectional view of a representation of a conformable device 20*qq* showing separated members, e.g., rows, islands or peninsulas, and the like, of foam material 66 affixed to one side of a pliable casing 22 and the presence of conformable material 41 between separated members of foam material 66.

Figure 54:
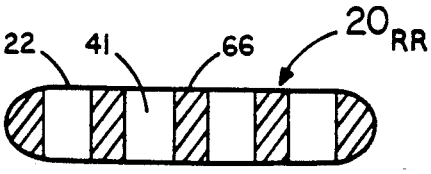
FIG. 54 is a cross-sectional view of a conformable device showing separated foam material members extending between and joining opposing sides of pliable casing and permitting the presence of resilient material between the foam material members.

FIG. 54 shows a cross-sectional view of a representation of a conformable device 20*rr* having foam material 66 members orientated approximately perpendicular to and in communication with opposing sides of pliable casing 22, thus permitting conformable material 41 to pass between such members, and the like.

Figure 55:
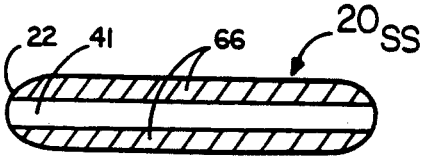
FIG. 55 is a cross-sectional view of a conformable device showing separated foam material members affixed to opposing sides of pliable casing permitting the presence of resilient material between the foam material members.

FIG. 55 shows a cross-sectional view of a representation of a conformable device 20*ss* having foam material 66 members affixed to opposing sides of pliable casing 22 and approximately parallel with these opposing sides, thus permitting a conformable material 41 to pass between opposite foam material 66 members, and the like.

Figure 56:
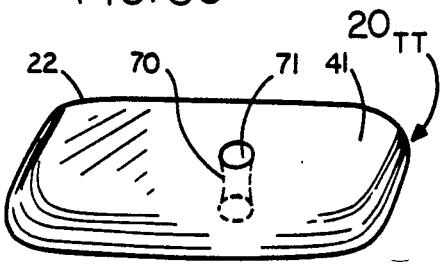
FIG. 56 is a cross-sectional perspective view of a conformable device showing a construction joining opposing sides of pliable casing and forming an opening for the ventilation of matter about line E—E.

FIG. 56 shows a cross-sectional perspective view of a representation of a conformable device 20*tt* showing a structural pattern 70 joining opposing sides of pliable casing 22 and forming an opening 71 for the ventilation of matter along line E—E. A plurality of such openings 71, and the like, can be formed in a conformable device 20*tt*. The conformable device 20*tt* can thereby then better dissipate heat and bodily fluids generated by the wearer during exercise. In addition, a plurality of such openings 71, and the like, can facilitate cleansing of an article of footwear 44, other article of equipment, device, or object.

Figure 57:
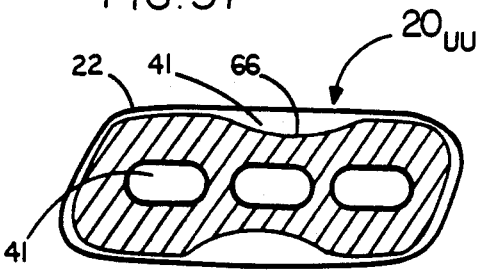
FIG. 57 is a cross-sectional perspective view of a conformable device showing resilient material encompassing supported foam members.

FIG. 57 shows a cross-sectional perspective view of a representation of a conformable device 20*uu* with conformable material 41 present about extensions of foam material 66. These extensions of foam material 66 are part of a more substantial member of foam material 66 shown in the area about the perspective view.

Figure 58:
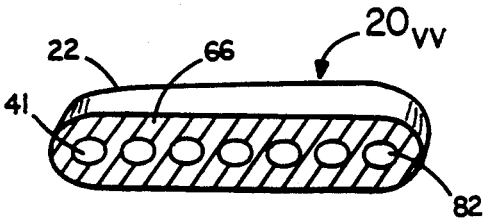
FIG. 58 is a cross-sectional perspective view of a conformable device showing resilient material present in passages formed in a foam material.

FIG. 58 shows a cross-sectional perspective view of a representation of a conformable device 20*vv* including a foam material 66 having passages 82 of desired shape for accommodating and directing the movement of conformable material 41 when the conformable device 20*vv* is subjected to a force application.

Figure 59:
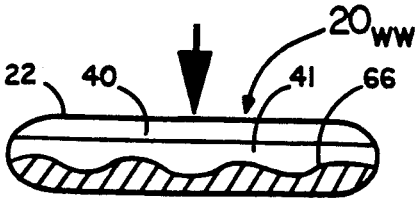
FIG. 59 is a cross-sectional view of a conformable device containing resilient material, foam material, and a void containing a gas.

FIG. 59 is a cross-sectional view of a conformable device 20*ww* containing a conformable material 41, foam material 66, and at least one void 40 containing at least one gas. In addition, an alternate conformable device 20*ww*, and the like, can be formed without the inclusion of a foam material 66. The primary line of anticipated force applications upon the conformable device 20*ww* is shown along line F—F.

It can be readily understood that it is technically feasible for the present invention to be used in combination, cooperation, or synergistic manner with other useful footwear inventions to yield at least one novel synergistic result and hybrid conformable device, e.g., at least one of the inventions of Marion F. Rudy including, but not limited to U.S. Pat. Nos. 3,760,056, 4,183,156, and 4,340,626. The teachings and inventions of Rudy are widely perceived as one of the most effective and commercially successful within the footwear industry. Therefore, several possible uses of a conformable device of the present invention with Rudy's inventions will be disclosed, not excluding equivalent or other use with other useful footwear inventions and devices.

As shown in FIG. 59, a conformable device 20*ww* could contain a so-called "supergas" of Rudy's teaching in order to selectively affect the mechanical properties of conformable device 20*ww*. Conversely, a conformable device 20*ww* can be used to likewise affect the mechanical, or other properties of a "diffusion pumping apparatus" of Rudy's teaching. Obviously, ambient air could be used in the place of a "supergas" of Rudy's teaching provided that the conformable device was so constructed as to maintain a desired range of inflation pressure. Generally, the higher the pressure of inflation attained by a conformable device, and/or the less the depth of the conformable device about the line of anticipated force applications, e.g., line F—F as shown in FIG. 59, the less will conformance be achieved with a portion of a wearer's anatomy which is placed in functional relation to conformable device 20*ww*, and the like. In this case, the present invention serves to greater extent in selectively attenuating force applications and resulting shock, as opposed to enhancing conformance or fit. In sum, it can be readily understood that the inclusion of a gas within the inner volume of a conformable device can yield at least one synergistic result, and a hybrid conformable device for use in articles of footwear.

Figure 60:
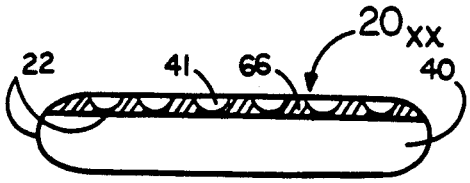
FIG. 60 is a cross-sectional view of a conformable device using a common portion for enclosure with an air bag.

As shown in FIG. 60, a conformable device 20*xx* can be formed externally with regards to an air bag or other cushioning device, but nevertheless share a common member of pliable casing 22 for structural integrity and enclosure. It can be readily understood that a conformable device 20*xx* can be used to render an air bag, or other cushioning device(s) or material(s) at least partially conformable with respect to a portion of a wearer's anatomy which is placed in a functional relation to conformable device 20*xx* as to impart a force application thereupon.

Figure 61:
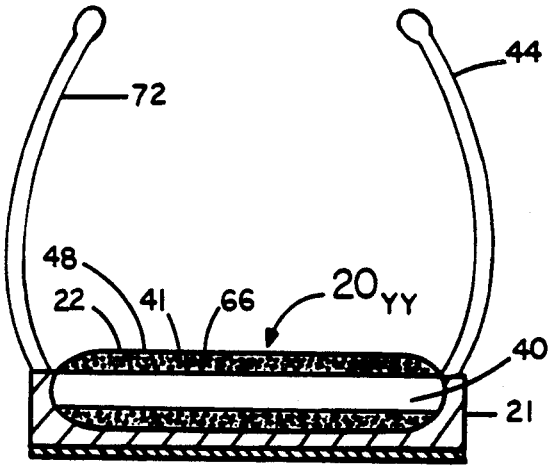
FIG. 61 is a cross-sectional view of an independent conformable device being used with an air bag.

As shown in FIG. 61, conformable device 20*yy* can render the superior or inferior portion of an air bag, or other cushioning device(s) or material(s) positioned in the area of the footbed 48 of an article of footwear 44 at least partially conformable to a portion of a wearer's anatomy.

Figure 62:
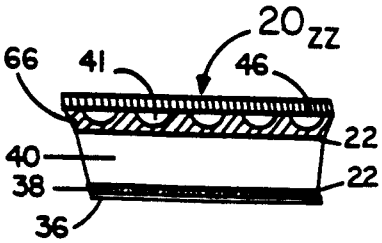
FIG. 62 is a cross-sectional perspective view of a conformable device being used with an air bag showing an overlying sockliner and an underlying protective release material which can be removed to expose a self-adhesive surface.

As shown in FIG. 62, in a cross-sectional view, conformable device 20*zz* can be used with an overlying sockliner 46 and an underlying air bag, or alternately, another cushioning device or material. In addition, a self-adhesive surface 38 which can be exposed by removal of a protective backing 36 can be included thereupon. Alternatively, it can be readily understood that conformable device 20*zz* can be used with an air bag, or other cushioning device(s) or material(s) which have been at least partially encapsulated, stock fitted, or otherwise at least partially comprise a portion of the midsole or outsole of an article of footwear 44.

Figure 63:
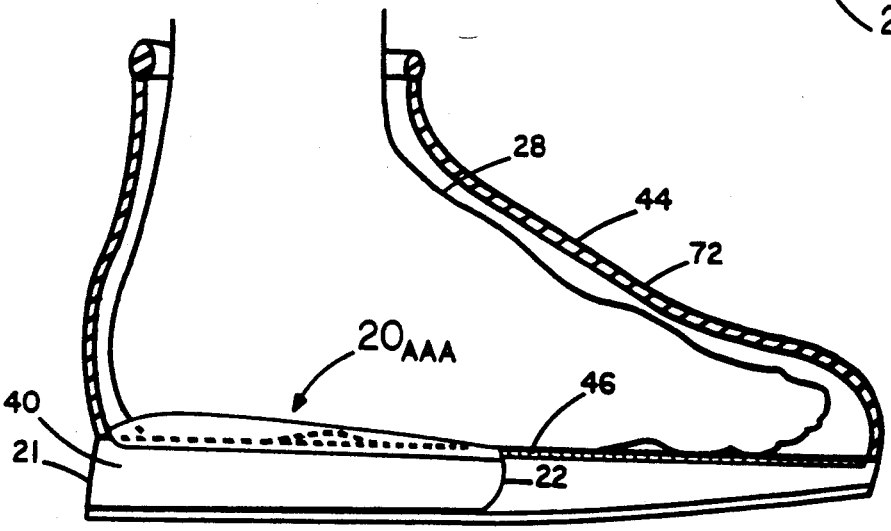
FIG. 63 is a cross-sectional view of a conformable device and air bag for use in the midsole of an article of footwear; and, FIG. 64 is a cross-sectional view of a conformable device which is at least partially encapsulated, or alternately, stock-fitted in relation to a sole of an article of footwear.

FIG. 63 is a cross-sectional view which shows a conformable device 20*aaa* and an air bag at least partially encapsulated, or stock-fitted within the midsole 21 of an article of footwear 44.

Figure 64:
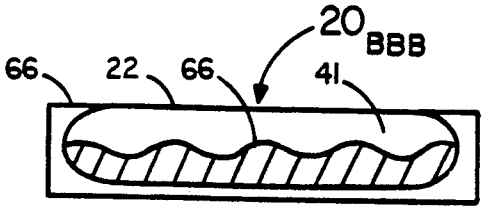

FIG. 64 shows conformable device 20*bbb* at least partially encapsulated in a foam material 66. It can be readily understood that conformable device 20*bbb*, and the like, can be partially or wholly encapsulated in a foam material 66, or other form of matter.

Hitherto, conformable devices of the present invention represented in FIGS. 29 and 65 have been discussed with regards to the possibility of including a conformable material 41 substantially comprising fluid matter which can comprise a resilient material substantially comprising solid matter after a working time. In particular, the possibility of using a selectively permeable material 110 in at least a portion of pliable casing 22 to gases including water vapor in connection with a water vapor cure elastomer contained within the chamber 51 of conformable devices 20*ccc* and 20*z* was discussed. Accordingly, when a barrier material is removed so as to place the selectively permeable material 110 comprising at least a portion of pliable casing 22 in fluid communication with water vapor present in the atmosphere, and in particular the environment within an article of footwear, water vapor can then pass through the selectively permeable material 110 comprising at least a portion of pliable casing 22 and cause conformable material 41 substantially comprising fluid matter to comprise a resilient material substantially comprising solid matter after a working time. The possible further inclusion of foam material having select shape generally conforming to a portion of a wearer's anatomy, and/or at least one void 40 containing at least one gas within the inner volume of chamber 51 of conformable device 20*z* was also discussed. Obviously, at least one void 40 containing at least one gas could also be included in conformable device 20*ccc*.

However, the preferred embodiment of a conformable device merits special attention, and utilizes the general structure of conformable devices 20*z*, and 20*ccc*, and the like. On page 29, lines 15–20 of this specification, a number of patents pertaining to silicone elastomers which are assigned to Dow Corning Corporation were disclosed and included by reference herein. A photocopy of page 1635 of the Patent Gazette dated Sep. 18, 1991 disclosing U.S. Pat. No. 4,957,963 entitled "Silicone Water Based Elastomers" has been included in the technical information appendage to the present application, hereby included by reference herein. This particular patent discloses a preferred aqueous silicone emulsion which cures to a reinforced elastomer upon removal of water by process of evaporation. It can be readily understood that such silicone materials, and the like, can be used as a preferred conformable material 41, and in particular, with conformable devices having the general construction of conformable devices 20*z*, and 20*ccc*, as shown in FIGS. 29, and 65, respectively. In this preferred embodiment of the present invention, removal of a barrier material, as disclosed, e.g., on page 30 of this specification, will place a selectively permeable material 110 to gases including water vapor comprising at least a portion of pliable casing 22 in fluid communication with the atmosphere. An aqueous silicone emulsion which cures to a reinforced elastomer upon removal of water by process of evaporation contained within the inner volume of the chamber 51 of a conformable device can thereby be caused to cure to an elastomer upon removal of water by process of evaporation as water vapor passes through the selectively peameable material 110 comprising at least a portion of pliable casing 22 of the conformable device.

In summary, the embodiments of conformable devices 20*z*, and 20*ccc* described previously required gases including water vapor to pass from the exterior of such conformable devices through a selectively permeable material 110 comprising at least a portion of pliable casing 22 into the interior of the conformable devices in order to cause a conformable material 41 substantially comprising fluid matter to comprise a resilient material substantially comprising solid matter after a working time. The preferred embodiment of a conformable device, e.g., 20*z*, or 20*ccc*, and the like, can include a conformable material 41 substantially comprising fluid matter, e.g., an aqueous silicone emulsion, which cures to form a resilient material substantially comprising solid matter after a working time, e.g., a silicone elastomer. This change in the phase state of conformable material 41 is caused, at least in part, by the evaporation of water. In these alternate embodiments, when a barrier material is removed which places the selectively permeable pliable casing 22, or alternatively, the conformable device as a whole in substantial isolation from the atmosphere, water vapor is able to pass from the inner volume of chamber 51 through the selectively permeable pliable casing 22 to the atmosphere, causing a change in the phase state of a conformable material 41 substantially consisting of fluid matter which will substantially consist of a resilient material substantially consisting of solid matter after a working time.

It can be readily understood that the inclusion of a foaming or blowing agent could additionally cause at least a portion of a conformable material substantially comprising fluid matter to change in phase state to at least one gas which could also pass through the selectively permeable material 110 which at least partially comprises pliable casing 22.

Commercially available examples of silicone water based elastomers include, but are not limited to the following products made available by the Dow Corning Corporation: ALLGUARD®, a housing foundation waterproofing material, SILICONE PLUS®, a caulking and sealing material, TRADEMATE®, a tile and fixture sealant, and PROFESSIONAL PLUMBER SILICONE SEALANT®. Some of these products cure to a hardness of approximately 25 Shore A durometer, and have approximately a 7–15 minute working time at room temperature. Cure time is on the order of 24 hours, as with most silicone elastomers, but the working or setting time is sufficiently brief as to enable a conformable device to substantially retain the shape imparted by a wearer making a force application upon a conformable device consonant with the teachings of the present invention.

For the sake of clarity, various alternate embodiments of the present invention disclosed herein and features thereof have been largely treated independently. However, it can be readily understood that alternate embodiments of the present invention for use with articles of footwear can include a plurality and various combinations of the alternate embodiments disclosed herein.

The procedure for employing the present invention can now be described with reference to various alternate embodiments of a conformable device of the present invention, as shown in FIGS. 1–65. When using the sockliner embodiment shown in FIG. 1, restraint 24 is removed to permit the reagents 27*a*, and 27*b* within enclosures 26*a*, 26*b* to mix freely, as shown in FIG. 2. The conformable device 20*a* is then manually kneaded as necessary. Mixing is easily accomplished because of the relative low viscosity of the reagents 27*a*, and 27*b*, and can be verified visually with the assistance of coloring agents. In addition, a protective release material 36 can then be removed from the conformable device, thereby exposing a self-adhesive surface(s) 38. The activated conformable device can then be affixed, e.g., to an overlying sockliner material 46 to form a one-piece unit 72. The conformable device can then be fitted within an article of footwear, as shown in FIG. 5. The conformable device will then form in at least partial conformance about a portion of a wearer's anatomy.

When appendage 50 is being used as a reservoir 64 for one or more of the reagents 27, e.g., as shown in FIG. 12, the procedures governing the preparation and use of conformable device 20*h* are substantially the same as those described above. In addition, if and when one or more internal breakable enclosure(s) 62 are being used to isolate one or more reagents 27, as shown in FIG. 14, the breakable enclosure(s) 62 should be ruptured thus enabling the reagents to be placed in fluid communication and mixed within the conformable device. The remaining procedures in this case are substantially the same as those described above.

When a conformable device uses an appendage 50 as a reservoir 64, e.g., as shown in FIGS. 12, the restraint(s) 24 and/or breakable enclosure(s) 62 should be suitably manipulated, as discussed above, to place the reagents 27*a*, and 27*b* in fluid communication whereby the reagents can be made to mix within the reservoir 64 of appendage 50. In addition, any restraint(s) 24, valve device(s) 60, or coupling device(s) 73 should then be suitably manipulated to place appendage 50 in fluid communication with chamber 51 of the conformable device. The conformable device is then placed in functional relation to an article of footwear which is then secured upon a wearer causing the conformable material 41, foam material 66, and any other form of matter contained within the inner volume of the conformable device to be configured in at least partial conformance about a portion of the wearer's anatomy. Alternatively, this step could be taken prior to the above procedure pertaining to the activation of the conformable material 41. In any event, the conformable material 41 then substantially comprises a resilient material after a working time. If and when necessary or desired, the next operation is to then remove the conformable device, or otherwise position the conformable device in order to excise one or more appendages 50 which could contain displaced excess resilient material. A self-adhesive patch 61 can then be applied to close the opening in the casing 22 created by removal of the appendage 50, as shown in FIG. 12*a*. The appendage containing excess resilient material can then be discarded. However, in some cases, an appendage 50 containing resilient material can serve a useful purpose in providing stability and support to a select area, as discussed above, and would not be removed. In addition, a self-adhesive surface 38 on the bottom of a conformable device, as shown in FIG. 3, can then be exposed by removing a protective release material 36 and the conformable device can then be affixed within an article of footwear 44.

When a conformable device 20*v* features a removably attachable appendage 50, as shown in FIG. 22, the first step is to properly manipulate the coupling device(s) 73 in order to attach and secure the appendage 50 to the chamber 51 of conformable device 20*y*. A valve device 60 can be actuated thereby, or by an independent action to place the appendage 50 in fluid communication with the chamber 51 of conformable device 20*v*. The removal of one or more restraints 24, and/or rupture of internal breakable enclosures (not shown) then places the reagents 27*a*, and 27*b* in fluid communication, whereby they can be mixed to form conformable material 41. When external pressure is applied to appendage 50 the conformable material 41 can be displaced into the inner volume of chamber 51. Conformable device 20*v* can then be secured in functional relation to an article of footwear and can then be formed in at least partial conformance about a portion of a wearer's anatomy. Conformable material 41 will substantially comprise a resilient material after a working time. It can be readily understood that appendage 50 can be removably attached either before or after conformable device 20*v* is donned by the wearer, depending upon the particular application. Likewise, it can be readily understood that conformable device 20*v*, and the like, can be secured in association with an article of footwear prior to implementation of the above procedures, depending upon the particular application.

When the conformable device 20*t* utilizes a container 96 as the reservoir 105 for reagents 27*a*, and 27*b*, as shown in FIG. 24, the container 96 should first be attached to the chamber 51 of conformable device 20*t* by suitable manipulation of coupling device(s) 73. A valve device 60 can thereby be simultaneously actuated to permit fluid communication between the container 96 and chamber 51 of conformable device 20*t*, or can alternatively be actuated by independent action. Plunger 97 is then depressed and the resulting pressure causes reagents 27*a*, and 27*b* to rupture seal 101, whereby they are placed in fluid communication and can be caused to mix as they pass through static mixing structure 102 contained within dispensing tube 104. In an alternate embodiment, static mixing structure 102 and/or dispensing tube 104 are contained within the chamber 51 of conformable device 20*t* (not shown). The conformable material 41 is then displaced into the chamber 51 of conformable device 20*t*. Consonant with the procedures described above, the conformable device 20*t* can then be formed in at least partial conformance about a portion of a wearer's anatomy.

Again, as shown in FIG. 25, a conformable device 20*u* can be inserted into a suitable compartment or pocket 46 of an inner boot or liner of an article of footwear by opening an access point 43 which can then be secured, e.g., by VELCRO® fasteners. The article of footwear is then secured upon the wearer. Consonant with the procedures described above, the conformable device 20*u* can then be formed in at least partial conformance about a portion of a wearer's anatomy.

When a conformable material forming a resilient material is used which has been selected to have a relatively short working time, the wearer or user should remain relatively inactive while the conformable material within the conformable device forms a resilient material substantially comprising solid matter. Given the conformable materials likely to be used in athletic applications it is advisable to form the conformable device with the wearer maintaining a standing position in order to better accommodate for the flexion of the arch(es) 34 and deformation of the foot 28. Whether the conformable device be formed in a standing or sitting position, the alignment of the wearer's leg and foot should preferably correspond to the neutral position, i.e., the lower leg (tibia) should be in line with the heel (calcaneus), and both should be perpendicular to the surface upon which the article of footwear rests. The knee and ankle joints should not be substantially flexed, and the alignment of the knee (patella) with respect to the foot should be such that the knee (patella) is roughly in line with the middle of the forefoot. The conditions of pronation or supination can thereby be limited or avoided. FIGS. 9 and 10 illustrate preferred standing and sitting neutral positions.

As discussed above, it would be possible to correct podiatric conditions by introducing pre-formed posts or wedges 42, or other devices incorporating desired correction in conjunction with conformable device 20*f*, as shown in FIGS. 7 and 8. Wedges 42 can be suitably affixed to the underside of the conformable device 20*f* prior to insertion into an article of footwear 44. It can be readily understood that the introduction of pre-formed posts or wedges 42, or other like devices is possible with various alternate conformable devices. Again, the introduction and use of such corrective devices in conjunction with the present invention should only be undertaken at the direction and with the supervision of a skilled and knowledgeable medical doctor.

When a conformable device 20*z*, or 20*ccc* utilizes a selectively permeable material 110 to gases including water vapor in at least of portion of the pliable casing 22, e.g., as shown in FIGS. 29, and 65, respectively, it can be readily understood that a gas which serves as a blowing or foaming agent for conformable material 41 can escape from the inner volume of the chamber 51 of conformable device 20*z*, or 20*ccc* through the permeable material 110 being used in at least a portion of pliable casing 22, whereas the conformable material 41 forming a resilient material after a working time will remain substantially isolated within the inner volume of conformable device 20*z*, or 20*ccc*. In addition, it is recognized that various terms are commonly used to describe changes in the physical state of various elastomers, e.g., tack time, skin time, pot life, tooling time, working life, setting time, partial and complete cure times. Such terms should not be used or interpreted in such a manner as to compromise the scope of the present invention.

Conformable devices 20*z*, or 20*ccc*, and the like, can be sealed within a barrier material, e.g., a moisture resistant bag or envelope so as to have a relatively loose fit therein. However, conformable devices 20*z*, or 20*ccc*, and the like, are preferably sealed within a substantially form fitting barrier material by conventional means, e.g., conformable devices 20*z* or 20*ccc* could be vacuum sealed or shrink-wrapped. Alternatively, a removable barrier material utilizing a pressure sensitive adhesive, or other conventional means can be used to expose a selectively permeable portion of a pliable casing.

In brief, relatively compact packaging constructions can permit the consumer to readily evaluate a conformable device within an article of footwear prior to initiating the steps which will substantially transform the conformable material into a resilient material after a working time. Such embodiments and associated methods constitute a significant improvement over the prior art from the standpoint of commercial viability within a retail environment.

The aqueous silicone emulsions described herein for use as a conformable material can be cleaned up during the manufacturing process while still in a liquid state by the use of water, and are amongst the most user-friendly conformable materials disclosed herein. In addition, some aqueous emulsions which can comprise a suitable conformable material for use in the present invention can undergo repeated changes in phase state, i.e., the change in phase state is reversable, whereby the resilient material substantially comprising solid matter can be caused to comprise a conformable material substantially comprising fluid matter, and vice-versa.

It can be readily understood that the elements disclosed in various alternate embodiments of a conformable device, e.g., as shown in FIGS. 1–65, can be combined as desired for use. That is, one or more element can be combined with another element, or a combination of elements to form a conformable device. A conformable device can then include various combinations, or a multiplicity of the elements disclosed herein, and accordingly, can require implementation of the appropriate procedures corresponding to their particular application and use.

It can be appreciated that various alternate embodiments of a conformable device provide a relatively simple, but effective practical method for enhancing the conformance, fit, support, comfort, cushioning and shock-absorbing qualities of articles of footwear. Further, the embodiments and features described herein anticipate a wide range of possible applications and the need to accommodate individual differences amongst the general public. In addition, it can be readily understood that alternate conformable devices can be used by a wearer or user of various articles of protective and athletic equipment, devices, or objects. For example, the use of shin guards, knee pads, thigh pads, hip pads, rib guards, shoulder pads, elbow pads, neck guards, face guards, protective hand and forearm equipment and helmets is prevalent in a large number of contact and non-contact sports, such as football, hockey, baseball, soccer, and volleyball. Protective helmets and knee pads are also used in the construction industry, and helmets of various kinds enjoy wide use in the military and in the field of transportation, e.g., bicycle and motorcycle operation. Suitable conformable devices could also be used to advantage with various prosthetic devices.

While the above detailed description of the invention contains many specificities, these should not be construed as limitations on the scope of the invention, but rather as exemplifications of several preferred embodiments thereof. Many other variations are possible. For example, the particular shape and content of a conformable device can vary from one application to another in light of the situational demands and the embodiment most likely to provide optimal performance. A conformable device can be formed within an article of footwear, or external to an article of footwear. Accordingly, the scope of the invention should be determined not by the embodiment(s) discussed or illustrated, but by the appended claims and their legal equivalents.

What is claimed is:

1. A conformable device for use in an article of footwear and conforming to and supporting a portion of a wearer's anatomy comprising a chamber having inner volume, said chamber comprising at least in part a pliable casing, said pliable casing at least partially comprising a selectively permeable material to gases including water vapor, a conformable material substantially comprising liquid matter substantially comprising an aqueous silicone emulsion which can comprise a resilient material substantially comprising solid matter after a working time when water in the form of gaseous water vapor evaporates from said conformable material into the atmosphere, said conformable material contained within said chamber and displacing at least a portion of said inner volume, a physical barrier substantially isolating said chamber from said atmosphere, whereby when said physical barrier is removed and a portion of said wearer's anatomy is positioned in functional relation to said conformable device causing a force application to be made thereupon and causing at least a portion of said conformable device to be formed in substantial conformance with said portion of said wearer's anatomy, said conformable device substantially retains the shape imparted by said portion of said wearer's anatomy when said conformable material substantially comprises said resilient material after a working time.

2. The conformable device according to claim 1, wherein said portion of said wearer's anatomy comprises said wearer's foot and said foot has a heel, arches, and metatarsal heads, and said conformable device at least partially underlies the arches and extends from an area about the heel to an area rearward of the metatarsal heads.

3. The conformable device according to claim 1, wherein said pliable casing is made from a material related from the group of polymers, copolymers, thermoplastics, natural and synthetic rubbers comprising silicone, urethane, polyurethane, polyester, polyethylene, polycarbonate, polyvinyl chloride, propylene, polyamide, latex, neoprene, nylon, vinyl, nitrile, butadiene acrylonitrile and styrene rubber, other natural and synthetic rubbers.

4. The conformable device according to claim 1, wherein said pliable casing comprises at least in part a textile material.

5. The conformable device according to claim 1, wherein said pliable casing comprises at least in part a substantially waterproof and breathable porometric material.

6. The conformable device according to claim 1, wherein said pliable casing comprises at least in part a substantially waterproof and breathable monolithic material.

7. The conformable device according to claim 1, wherein said resilient material comprises an elastomeric material.

8. The conformable device according to claim 1, wherein said resilient material is made from a material related from the group of polymers, copolymers, thermoplastics, and natural and synthetic rubbers comprising silicone, silicone gel, urethane, polyurethane, polyethylene, polycarbonate, polyvinyl chloride, propylene, polyamide, latex, neoprene, nitrile, vinyl, nylon, polyester, butadiene acrylonitrile and styrene rubber, other natural and synthetic rubbers.

9. The conformable device according to claim 1, wherein said conformable material includes a blowing agent and comprises said resilient material after a working time.

10. The conformable device according to claim 9, wherein said blowing agent is related from the group of physical and chemical blowing agents comprising water, water vapor, carbon dioxide, nitrogen, sodium bicarbonate, dinitrosopentamethylenetetramine, sulfonyl hydrazides, azodicarbonamide, p-toluenesulfonyl semicarbazide, 5-phenyltetrazole, diisopropylhydrazodicarboxylate, sodium borohydrite, and aliphatic hydrocarbons and their chloro- and fluoro- derivatives; isomers of pentane, hexane, heptane, fluorocarbons, trichlorofluoromethane, dichlorodifluoromethane, dichlorotetrafluoroethane, monochlorodifluoromethane, and methylene chloride.

11. The conformable device according to claim 1, further including a void substantially filled with a gas displacing at least a portion of the inner volume of said chamber.

12. The conformable device according to claim 1, further including a foam material substantially comprising solid matter having select form generally conforming to a portion of said wearer's anatomy placed in communication with the inner volume of said conformable device, whereby said conformable material can be placed in communication with said foam material and the select and coordinated use of said foam material with said conformable material provides select mechanical properties as between at least two portions of said conformable device when said conformable material forms said resilient material after a working time.

13. The conformable device according to claim 12, wherein said foam material is made from a material selected from the group of open and closed cell foams comprising silicones, urethanes, micro-cellular, ester, ether, and reticulated polyurethanes, polyvinyl chloride, polyamide, melamine, linear and cross-linked polyethylene, latex, neoprene, nitrile, other natural and synthetic rubbers.

14. The conformable device according to claim 1, wherein said conformable device can be removably positioned in said article of footwear.

15. The conformable device according to claim 1, wherein said evaporation of water in the form of water vapor initiates a cross-linking chemical reaction causing said conformable material to substantially comprise said resilient material after a working time.

16. The conformable device according to claim 1, wherein said conformable device at least partially attenuates force applications and dampens shock.

17. A method for making a conformable device for use in an article of footwear and conforming to and supporting a portion of a wearer's anatomy comprising:

a) selecting an article of footwear;

b) selecting a conformable material substantially comprising liquid matter substantially comprising an aqueous silicone emulsion which can comprise a resilient material substantially comprising solid matter after a working time when placed in fluid communication with the atmosphere to cause the evaporation of water in the form of water vapor from said aqueous silicone emulsion;

c) selecting a chamber having inner volume at least partially comprising a pliable casing, said pliable casing at least in part selectively permeable to gases including water vapor;

f) placing said conformable material within the inner volume of said chamber;

g) providing a physical barrier so as to substantially isolate said conformable material contained within the inner volume of said chamber from fluid communication with said atmosphere;

i) removing said physical barrier placing said conformable material in fluid communication with said atmosphere to initiate said conformable material to comprise said resilient material;

j) positioning said conformable device within said article of footwear; and k) positioning a portion of said wearer's anatomy in functional relation with said article of footwear causing a force application to be made upon said conformable device and causing at least a portion of said conformable device to be formed in substantial conformance with said portion of said wearer's anatomy, said conformable device at least partially retaining the shape imparted by said portion of said wearer's anatomy when said conformable material substantially comprises said resilient material after a working time.

18. The method according to claim 17, wherein said portion of said wearer's anatomy comprises a portion of said wearer's foot.

19. The method according to claim 17, further including a foam material substantially comprising solid matter having select form generally conforming to a portion of said wearer's anatomy placed in communication with the inner volume of said conformable device, whereby said conformable material can be placed in communication with said foam material and the select and coordinated use of said foam material with said conformable material provides select mechanical properties as between at least two portions of said conformable device when said conformable material forms said resilient material after a working time.

20. The method according to claim 17, further including a void substantially filled with a gas displacing at least a portion of the inner volume of said chamber.

21. A conformable device for use in an article of footwear and conforming to and supporting a portion of a wearer's anatomy comprising a chamber having inner volume, said chamber comprising at least in part a pliable casing, said pliable casing at least partially comprising a selectively permeable material to gases including water vapor, a conformable material substantially comprising liquid matter substantially comprising an aqueous emulsion which can comprise a resilient material substantially comprising solid matter after a working time when water in the form of gaseous water vapor evaporates from said conformable material into the atmosphere, said conformable material contained within said chamber and displacing at least a portion of said inner volume, a physical barrier substantially isolating said chamber from said atmosphere, whereby when said physical barrier is removed and a portion of said wearer's anatomy is positioned in functional relation to said conformable device causing a force application to be made thereupon and causing at least a portion of said conformable device to be formed in substantial conformance with said portion of said wearer's anatomy, said conformable device substantially retains the shape imparted by said portion of said wearer's anatomy when said conformable material substantially comprises said resilient material after a working time.

22. The conformable device according to claim 21, wherein the change in the phase state of said conformable material is reversable and said resilient material substantially comprising solid matter can be caused to comprise said conformable material substantially comprising liquid matter.

23. A method for making a conformable device for use in an article of footwear and conforming to and supporting a portion of a wearer's anatomy comprising:

a) selecting an article of footwear;

b) selecting a conformable material substantially comprising liquid matter substantially comprising an aqueous emulsion which can comprise a resilient material substantially comprising solid matter after a working time when placed in fluid communication with the atmosphere to cause the evaporation of water in the form of water vapor from said aqueous emulsion;

c) selecting a chamber having inner volume at least partially comprising a pliable casing, said pliable casing at least in part selectively permeable to gases including water vapor;

f) placing said conformable material within the inner volume of said chamber;

g) providing a physical barrier to substantially isolate said conformable material contained within the inner volume of said chamber from fluid communication with said atmosphere;

i) removing said physical barrier; placing said conformable material in fluid communication with said atmosphere to initiate said conformable material to comprise said resilient material;

j) positioning said conformable device within said article of footwear; and k) positioning a portion of said wearer's anatomy in functional relation with said article of footwear causing a force application to be made upon said conformable device and causing at least a portion of said conformable device to be formed in substantial conformance with said portion of said wearer's anatomy, said conformable device at least partially retaining the shape imparted by said portion of said wearer's anatomy when said conformable material substantially comprises said resilient material after a working time.

24. The method according to claim 23, wherein the change in the phase state of said conformable material is reversible, and said resilient material substantially comprising solid matter can be caused to comprise said conformable material substantially comprising liquid matter.

* * * * *